US006206505B1

(12) United States Patent
Yoshihira et al.

(10) Patent No.: US 6,206,505 B1
(45) Date of Patent: Mar. 27, 2001

(54) LIQUID CARRYING METHOD, A LIQUID CARRYING APPARATUS, AND A LIQUID DISCHARGING METHOD AND A LIQUID DISCHARGE HEAD UTILIZING SUCH LIQUID CARRYING METHOD AND APPARATUS

(75) Inventors: Aya Yoshihira, Yokohama; Hiroyuki Ishinaga, Tokyo; Toshio Kashino, Chigasaki; Kiyomitsu Kudo, Kawasaki; Yoichi Taneya, Yokohama; Hiroyuki Sugiyama, Sagamihara, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/089,479

(22) Filed: Jun. 2, 1998

(30) Foreign Application Priority Data

Jun. 6, 1997 (JP) ..... 9-149380

(51) Int. Cl.[7] ..... B41J 2/14; B41J 2/05
(52) U.S. Cl. ..... 347/48; 347/65
(58) Field of Search ..... 347/63, 65, 48

(56) References Cited

U.S. PATENT DOCUMENTS

| | | | | |
|---|---|---|---|---|
| 4,313,124 | | 1/1982 | Hara | 347/57 |
| 4,345,262 | | 8/1982 | Shirato et al. | 347/57 |
| 4,459,600 | | 7/1984 | Sato et al. | 347/47 |
| 4,463,359 | | 7/1984 | Ayata et al. | 347/56 |
| 4,480,259 | | 10/1984 | Kruger et al. | 347/63 |
| 4,558,333 | | 12/1985 | Sugitani et al. | 347/65 |
| 4,608,577 | | 8/1986 | Hori | 347/66 |
| 4,723,129 | | 2/1988 | Endo et al. | 347/56 |
| 4,740,796 | | 4/1988 | Endo et al. | 347/56 |
| 5,278,585 | | 1/1994 | Karz et al. | 347/65 |
| 5,467,112 | | 11/1995 | Mitani | 347/1 |
| 5,731,828 | * | 3/1998 | Ishinaga et al. | 347/48 |
| 5,754,201 | | 5/1998 | Ishinaga et al. | 347/62 |
| 5,943,074 | * | 8/1999 | Kashino et al. | 347/65 |

FOREIGN PATENT DOCUMENTS

| | | | | |
|---|---|---|---|---|
| 0 737 581 | | 10/1996 | (EP) | B41J/2/05 |
| 811489 | * | 6/1997 | (EP) | 347/65 |
| 0 811 492 | | 12/1997 | (EP) | B41J/2/05 |
| 54-56847 | | 5/1979 | (JP) . | |
| 55-81172 | | 6/1980 | (JP) . | |
| 59-26270 | | 2/1984 | (JP) . | |
| 59-123670 | | 7/1984 | (JP) . | |
| 59-138461 | | 8/1984 | (JP) . | |
| 60-71260 | | 4/1985 | (JP) . | |
| 61-59916 | | 4/1986 | (JP) . | |
| 62-261452 | | 11/1987 | (JP) | B41J/3/04 |
| 1-247168 | | 10/1989 | (JP) | B41J/3/04 |
| 2-137930 | | 5/1990 | (JP) | B41J/2/05 |
| 5-229122 | | 9/1993 | (JP) | B41J/2/05 |

* cited by examiner

*Primary Examiner*—John Barlow
*Assistant Examiner*—Juanita Stephens
(74) *Attorney, Agent, or Firm*—Fitzpatrick, Cella, Harper & Scinto

(57) ABSTRACT

A liquid carrying method is to carry liquid by pressure exerted by the creation of air bubble, which comprises the step of using an apparatus provided with a first liquid flow path for enabling the carrying liquid to flow, a second liquid flow path provided with the air bubble generating area for creating air bubble, a heat generating device arranged for the air bubble generating area to generate heat for the creation of the air bubble and a movable separation film for separating the first liquid flow path and the second liquid flow path and the step of carrying liquid in the first liquid flow path by displacing the movable separation film, having direction regulating means for regulating the displacement direction of the movable separation film, to the first liquid flow path side by the pressure exerted by the creation of the air bubble. With the method thus structured, it becomes possible to carry liquid efficiently and discharge it from each of the discharge openings stably with high discharge force in good discharge efficiency.

122 Claims, 21 Drawing Sheets

LIQUID CARRYING METHOD, A LIQUID CARRYING APPARATUS, AND A LIQUID DISCHARGING METHOD AND A LIQUID DISCHARGE HEAD UTILIZING SUCH LIQUID CARRYING METHOD AND APPARATUS

BACKGROUND OF THE INVENTION

1. Field of the Invention

The present invention relates to a liquid carrying method and a liquid carrying apparatus, which use a movable separation film displaceable by the application of the bubble generation pressure generated by the film boiling of liquid. The invention also relates to a liquid discharging method and a liquid discharge head, which use such liquid carrying method and apparatus.

2. Related Background Art

As means for carrying liquid, various ones have been used conventionally.

One of them is a pump that carries liquid using an electric motor. For a pump of the kind, the power supply source is arranged outside the liquid flow path even when the flow of liquid should be produced in a very small quantity by use of a tube whose diameter is several millimeters or less.

Also, there is a method for carrying liquid with the provision of a plurality of heat generating devices arranged on the bottom surface of a liquid flow path where the liquid flows. Here, each of the heat generating devices is driven to generate heat, and create each of the air bubbles by the generated heat. The liquid is then carried by the application of pressure generated by each of the air bubbles thus created.

This method is such that a plurality of heat generating devices, which are arranged on the bottom surface of liquid flow path where liquid flows, are driven one after another to create each of the air bubbles in the direction of the liquid flow, and that the liquid is carried by the application of pressure thus generated by each of the created air bubbles.

Also, there is a method in which at least one heat generating device and a rotator that rotates freely are arranged in the liquid flow path so as to rotate the rotator by means of the pressure of each of the air bubbles created by the application of heat generated by the heat generating device.

For the method of the kind, there is no need for the provision of a plurality of heat generating devices in the liquid flow direction. It should be good enough if only a heat generating device is arranged in a position facing the blades of the rotator. Here, the control is needed just for the sequential rotation if only the center of the rotator is positioned to agree with the center of the heat generating device thus arranged.

For other methods, there have been known a diaphragm type, a gear type, or some others for a quantitative injection pump or the like. Also, there have been known a bellows type or a tube type for carrying liquid in a quantity smaller still, among some others.

Meanwhile, as the methods for discharging liquid, there are disclosed in Japanese Patent Publication No. 61-59916, Japanese Patent Application Laid-Open No. 55-81172, Japanese Patent Application Laid-Open No. 59-26270, and some others, those methods in which bubble generating liquid is caused to generate bubbles by the application of thermal energy through a flexible film that separates the liquid (bubble generating liquid) used for creating each of air bubbles by heat and the liquid (discharge liquid) used for discharging so as to carry over the pressure exerted by generating bubbles to the discharge liquid. In accordance with such disclosed techniques, ink that serves as discharge liquid, and bubble generating liquid are separated by use of a flexible film such as silicone rubber. Then, the structure is arranged so that discharge liquid is not allowed to be in contact with any one of the heat generating devices directly, and at the same time, the pressure exerted by generating bubbles of the bubble generating liquid is carried over to the discharge liquid by the deformation of the flexible film. With the structure thus arranged, it is attained to prevent deposit from being accumulated on each surface of the heat generating devices, while improving the selection freedom of discharge liquids or the like.

However, there is encountered a problem that the structure which uses the flexible film to separate the discharge liquid and the bubble generating liquid completely needs the amount of displacement which is too great to obtain a strong discharge force or to act effectively upon the discharge of a highly viscous liquid, although the structure makes it possible to separate them.

Here, also, there are problems given below as to the conventional liquid carrying techniques described above.

(1) The liquid carrying apparatus that uses an electric motor has its outer diameter of 100 mm to 200 mm even for the smaller ones. Moreover, as described above, the power source should be arranged outside the liquid flow path, and the electric-supply should be made from the outside. Therefore, when this apparatus is incorporated in the smaller and lighter medical equipment, biotechnological equipment, OA equipment, and the like, which are more in demand in recent years, it is inevitable that the intended system is made larger contrary to such requirement of late.

Also, with this apparatus, although a specific quantity of liquid can be supplied continuously, it is impossible to control the supply of liquid in the unit quantity of less than $1/2000$ g/sec in particular if a fixed quantity should be carried at certain intervals.

(2) The liquid carrying apparatus, which uses the pressure exerted by each of the air bubbles created by the application of heat generated by heat generating devices arranged on the bottom surface of the liquid flow path, should use the pressure of the created air bubbles that act upon the liquid which also reside on the upstream side of the liquid carrying path. This type of apparatus is not necessarily regarded as the one using efficient method. Also, the liquid which is carried should run on each of the heat generating devices that gives heat to it. Therefore, any liquid whose property is not strong enough against heat cannot be carried easily. There is a fear that burnt substance or other deposit is accumulated on each of the heat generating devices.

(3) The liquid carrying apparatus, which is provided with at least one heat generating device and a rotator that freely rotates, and which is arranged to carry liquid by the rotation of the rotator rotative by the pressure exerted by creation of air bubble using the heat generating device, should provide a wide surface for the rotator in order to receive the pressure exerted by the created air bubble. Therefore, the size of the rotator is a decisive factor that affects the size of the apparatus, hence leading to a problem that the apparatus should be made larger to a certain extent anyway. Also, the liquid which is carried should run on the heat generating device that gives heat to it. As a result, there is a difficulty in carrying the liquid whose property is not strong enough against heat. Also, there is a fear that burnt substance or other deposit is accumulated on the heat generating device.

Now, the present invention is designed in consideration of the problems encountered in the conventional art as described above. It is the main object of the invention to provide a liquid carrying method and a liquid carrying apparatus, which are capable of carrying liquid efficiently by use of a movable separation film displaceable by the application of pressure exerted by each of air bubbles created by film boiling generated in liquid.

It is a second object of the invention to provide a liquid carrying method and a liquid carrying apparatus, which are capable of carrying even the liquid whose property is weaker against heat without causing the accumulation of burnt substance or other deposit on the heat generating devices.

Also, it is a third object of the invention to provide a liquid carrying method and a liquid carrying apparatus, which are made smaller and capable of controlling the supply of liquid in the unit quantity of less than 1/2000 g/sec.

Further, it is a fourth object of the invention to provide a preferable liquid discharge head that uses the liquid carrying apparatus of the present invention.

SUMMARY OF THE INVENTION

In order to achieve the above-mentioned objects, a liquid carrying method of the present invention is to carry liquid by pressure exerted by the creation of air bubble, which comprises the step of using an apparatus provided with a first liquid flow path for enabling the carrying liquid to flow; a second liquid flow path provided with the air bubble generating area for creating air bubble; a heat generating device arranged for the air bubble generating area to generate heat for the creation of the air bubble; and a movable separation film for separating the first liquid flow path and the second liquid flow path; and the step of carrying liquid in the first liquid flow path by displacing the movable separation film, having direction regulating means for regulating the displacement direction of the movable separation film, to the first liquid flow path side by the pressure exerted by the creation of the air bubble.

Here, as the structure that implements the displacement process specifically, which is characteristic of the invention described above, the structures of the embodiments described hereunder can be cited. In this respect, however, it is to be understood that any other structures that may be able to attain the displacement process described above are included in the technical thought of the present invention, and that such structures fall within the scope of the present invention.

Now, the typical structural example of the apparatus designed in accordance with the present invention is described hereunder. The term "means for regulating direction" referred to in the description given below is meant to include the structure of the movable separation film itself (for example, the distribution of the elastic modulus, the combination of the stretching portion by deformation and the non-stretching portion thereby, or the like or the additional members that act upon the movable separation film, or those structured by the provision of the first liquid flow path and the like), and all of these combinations besides its structure itself.

The typical structure of the present invention is to carry liquid by pressure exerted by the creation of air bubble, which comprise the step of using an apparatus provided with a first liquid flow path for enabling the carrying liquid to flow; a second liquid flow path provided with the air bubble generating area for creating air bubble; a heat generating device arranged for the air bubble generating area to generate heat for the creation of the air bubble; and a movable separation film for separating the first liquid flow path and the second liquid flow path essentially or more preferably, separating them completely, the movable separation film being provided with the pressure direction control member having the free end thereof on one end and the fulcrum point thereof on the other end on the air bubble generating area; and the step of carrying liquid in the first liquid flow path from the fulcrum point side to the free end side of the pressure direction control member by displacing the free end to the first liquid flow path side by enabling pressure exerted by the creation of the air bubble to act upon the pressure direction control member through the movable separation film in order to guide the pressure to the first liquid flow side.

In accordance with the present invention, the liquid in the liquid flow path is pushed to flow by each of the air bubbles created by the application of heat generated by each of the heat generating devices, as well as by means of the movable separation film that is displaceable by the pressure exerted by each of such created air bubbles. In this manner, liquid is carried.

Particularly, the provision of a plurality of heat generating devices makes it possible to obtain the stabilized liquid flow not necessarily by the length of the passage of flow.

Also, by dividing the liquid flow path into two for use of different liquids: one for liquid to be carried and the other for use of the bubble generating liquid. As a result, it becomes possible to carry even the liquid which is weak against heat or the liquid which cannot be generated bubbles easily. There is also no possibility that burnt substance or any other deposit is accumulated on each of the heat generating devices.

Also, the displacement of pressure direction control member is arranged to act upon only on the downstream side of the liquid flow. Therefore, it is possible to prevent the liquid from flowing in the reverse direction.

In this manner, the pressure that should act upon the liquid carriage is concentrated on the downstream side of the liquid flow. The liquid is then carried in good efficiency.

BRIEF DESCRIPTION OF THE DRAWINGS

FIG. 21A shows the apparatus provided with a protection film; FIG. 21B shows the apparatus having no protection film.

DETAILED DESCRIPTION OF THE PREFERRED EMBODIMENTS

Now, hereinafter, the description will be made of a first embodiment in accordance with the present invention.

Figure 1:
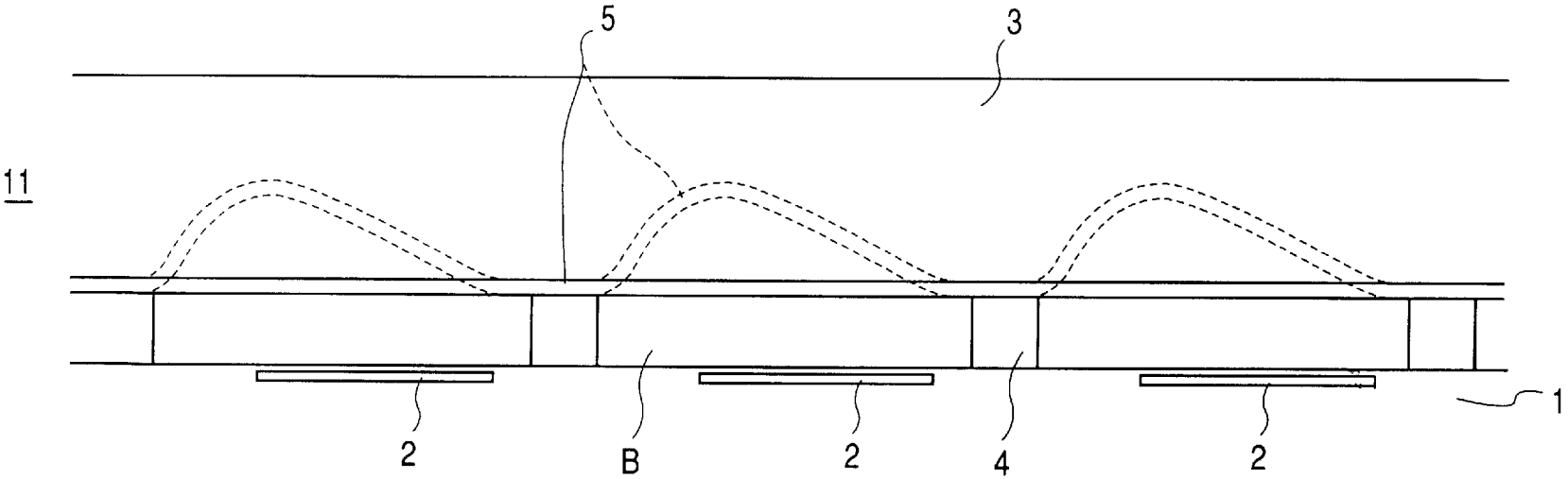
FIG. 1 is a cross-sectional view which schematically shows a structure in accordance with a first embodiment of the present invention, taken in the flow direction therein.

FIG. 1 is a cross-sectional view schematically showing a structure in accordance with a first embodiment of the present invention, taken in the flow direction therein. The discharge opening is arranged in the end zone of the first flow path. The displacement areas of a movable separation film, which is displaceable along the development of created air bubbles are arranged on the upstream side of the discharge opening (with respect to the flow direction of the discharge liquid in the first liquid flow path). Also, a second liquid flow path retains bubble generating liquid or it is filled with bubble generating liquid (preferably, it is capable of being refilled with bubble generating liquid or more preferably, it is capable of carrying bubble generating liquid). Also, this flow path is provided with air bubble generating areas.

As shown in FIG. 1, the present embodiment is provided with the second liquid flow path 4 for use of bubble generating liquid on the substrate 1 where a plurality of heat generating devices (in FIG. 1, three devices are shown, each formed by a heat generating resistor of 40 $\mu$m×105 $\mu$m in accordance with the present embodiment) which gives thermal energy to liquid for creating air bubble, respectively. On the second flow path, the first flow path 3 is arranged for liquid carriage. Between the second flow path 4 and the first flow 3, there is arranged a movable separation film 5 formed by a thin elastic film so as to separate the liquid residing on the first liquid flow path 3 for carriage, and the bubble generating liquid residing on the second liquid flow path 4.

When the heat generating device 2 is energized, heat is caused to act upon the bubble generating liquid in the air bubble generating area B between the movable separation film 5 and the heat generating device 2. Then, an air bubble is created in the bubble generating liquid by means of the film boiling phenomenon disclosed in the specification of U.S. Pat. No. 4,723,129. The pressure exerted by the creation of the air bubble acts upon the movable separation film 5 preferentially. Thus, the movable separation film 5 is displaced largely to the downstream side as indicated by dotted lines in FIG. 1, and guided to the downstream side by the pressure exerted by the air bubble created in the air bubble generating area B. In this way, it is made possible to carry the liquid in the first flow path.

In accordance with the present embodiment, the air bubble generating area is positioned more on the upstream side of the discharge opening side with respect to the flow direction of discharge liquid described above. In addition, the movable separation film is made longer to provide its movable region than the electrothermal transducing device that forms the air bubble generating area. However, between the end portion of the electrothermal transducing device on the upstream side and the common liquid chamber in the first liquid flow path, or preferably on the aforesaid end portion on the upstream side, a fixed portion (not shown) should be provided. Therefore, the essential range within which the separation film can move is understandable with reference to the representations in FIGS. 2A to 2E, 3A to 3E and 4A to 4C.

FIGS. 2A to 2E, 3A to 3E and 4A to 4C are views which illustrate the examples of the liquid discharging method applicable to the present invention. Each state of the movable separation film shown in FIGS. 2A to 2E, 3A to 3E and 4A to 4C is the element that represents all of those obtainable from the factors related to the elasticity of the movable separation film itself, the thickness thereof, or any other additional structures needed therefor.

Now, the description will be made of the two examples applicable to the embodiments of the present invention.

(FIRST EXAMPLE)

FIGS. 2A to 2E are cross-sectional views which illustrate the first example of the liquid discharging method applicable to the present invention, taken in the direction of flow path thereof, (the case where the displacement process of the present invention takes place from the midway of the discharging process).

As shown in FIGS. 2A to 2E, in accordance with the present example, the first liquid supplied from the first common liquid chamber 143 is filled in the first liquid flow path 3 which is directly connected with the discharge opening 11. Also, in the second liquid flow path 4 which is provided with the air bubble generating area B, the liquid for bubble generation use is filled, which is caused to generate bubbles when thermal energy is given by means of the heat generating device 2. In this respect, between the first liquid flow path 3 and the second liquid flow path 4, a movable separation film 5 is arranged to separate them from each other. Here, the movable separation film 5 and the orifice plate 9 are closely fixed with each other. As a result, there is no possibility that liquids in each of the flow paths are allowed to be mixed.

Here, the movable separation film 5 is not provided usually with any directivity when it is displaced by the creation of air bubble in the air bubble generating area B. In some cases, the movable separation film may be displaced rather toward the common liquid chamber side where a higher degree of freedom is available for displacement.

For this example, attention is given to this movement of the movable separation film 5. Means for regulating the displacement is provided for the movable separation film 5 itself, which may act upon it directly or indirectly. With the provision of such means, it is made possible to direct to the discharge opening side the displacement of the movable separation film 5 that may result from the creation of air bubble (such as movement, expansion or stretching, among some others).

Figure 2A:
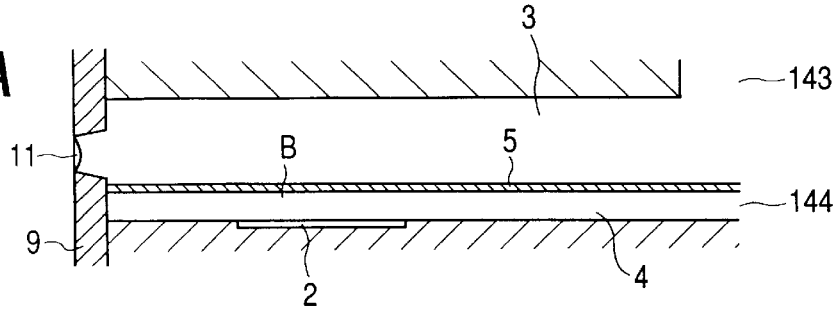
FIGS. 2A, 2B, 2C, 2D and 2E are cross-sectional views which illustrate the first example of a liquid discharging method to which the present invention is applicable, taken in the flow direction therein.

In the initial condition shown in FIG. 2A, the liquid in the first liquid flow path 3 is drawn into the vicinity of the discharge port 11 by a capillary force. In this embodiment, the discharge port 11 is located downstream of the direction of the liquid flow in first liquid flow path 3 with respect to a projected area of the heat generating element 2 to the first liquid flow path 3.

Figure 2B:
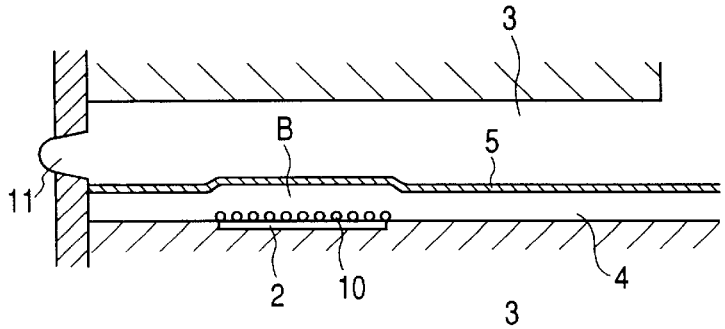

In this state, when thermal energy is given to the heat generating device 2 (for the present example, a heat generating resistor in the shape of 40 $\mu$m×105 $\mu$m), the heat generating device 2 is heated abruptly. The surface thereof, which is in contact with the second liquid in the air bubble generating area B, gives heat to the liquid to generate bubbles (FIG. 2B). The air bubble 10 thus created by the heat bubble generation is an air bubble created on the basis of such film boiling as disclosed in the specification of U.S. Pat. No. 4,723,129. It is created on the entire surface of the heat generating device at a time accompanied by extremely high pressure. The pressure thus exerted at that time becomes pressure waves to propagate the second liquid in the second liquid flow paths 4, hence acting upon the movable separation film 5. In this manner, the movable separation film 5 is displaced to initiate the discharge of the second liquid in the first liquid flow path 3.

Figure 2C:
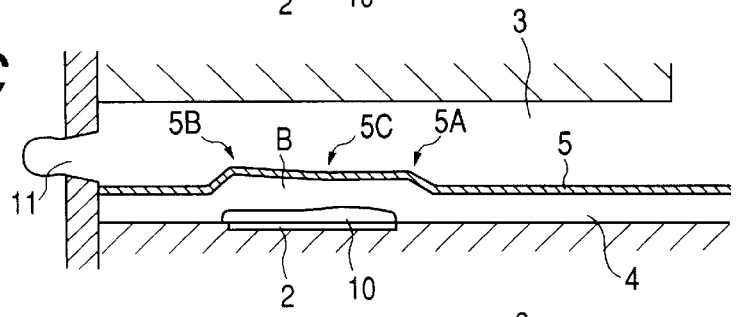

The air bubble 10 created on the entire surface of the heat generating device 2 is developed rapidly to present itself in the form of film (FIG. 2C). The expansion of the air bubble 10 brought about by the extremely high pressure exerted in the initial stage causes the movable separation film 5 to be further displaced. In this manner, the discharge of the first liquid in the first liquid flow path 3 from the discharge opening 11 is in progress.

Figure 2D:
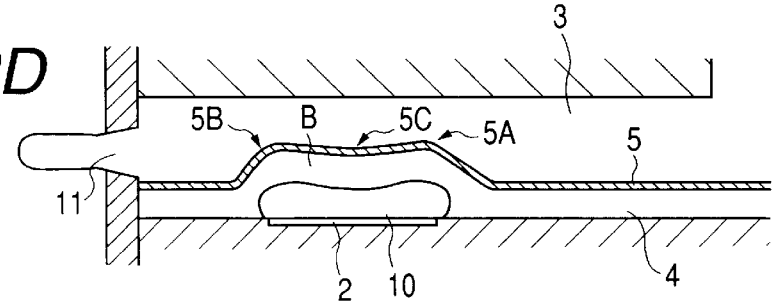

After that, the air bubble 10 is further developed. Then, the displacement of the movable separation film 5 becomes larger (FIG. 2D). Here, the movable separation film 5 is continuously stretched up to the state shown in FIG. 2D so that the displacement thereof on the portion at 5A on the upstream side and that on the portion at 5B on the downstream side are made substantially equal with respect to the central portion at 5C of the area of the movable separation film 5 that faces the heat generating device 2.

After that, when the air bubble 10 is further developed, the portions of the air bubble 10 and the displacing movable separation film 5 on the downstream side at 5B are displaced relatively larger in the direction toward the discharge opening side than the portions thereof on the upstream side at 5A. In this manner, the first liquid in the first liquid flow path 3 is moved directly in the direction toward the discharge opening 11 (FIG. 2E).

Here, with the provision of the displacement process of the movable separation film 5 in the discharge direction on the downstream side thereof, which enables liquid to move directly in the direction toward the discharge opening, it becomes possible to enhance the discharge efficiency. Further, the movement of liquid to the upstream side becomes relatively smaller, which acts effectively upon the liquid refilling (liquid supply from the upstream side) into the nozzles, particularly onto the displacement area of the movable separation film 5.

Figure 2E:
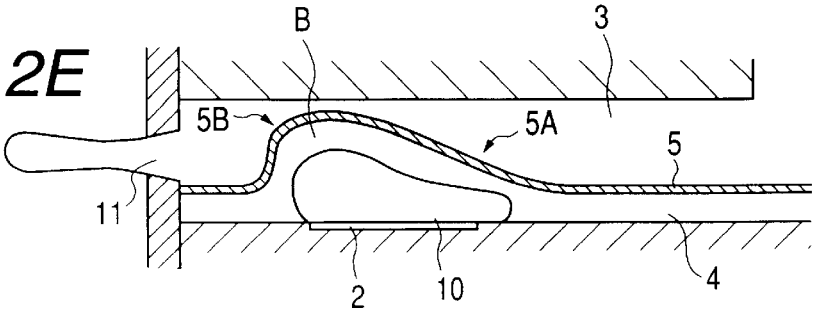

Also, as shown in FIG. 2D and FIG. 2E, when the movable separation film 5 itself is also displaced in the direction toward the discharge opening so that its state may change as represented in FIGS. 2D and 2E, respectively, it becomes possible not only to enhance the discharge efficiency as well as the refilling efficiency, but also, to implement the increase of the discharge amount by carrying the first liquid residing in the projection area of the heat generating device 2 in the first liquid flow path 3 in the direction toward the discharge opening.

(SECOND EXAMPLE)

FIGS. 3A to 3E are cross-sectional views which illustrate the second example of the liquid discharging method applicable to the present invention, taken in the direction of flow path thereof, (the example being such that the displacement process of the present invention is arranged from the initial stage of the processes provided for the method).

This example is structured in the same manner as the first example fundamentally. As shown in FIGS. 3A to 3E, the first liquid supplied from the first common liquid chamber 143 is filled in the first liquid flow path 13 which is directly connected with the discharge opening 11. Also, in the second liquid flow path 14 which is provided with the air bubble generating area B, the liquid for bubble generation use is filled, which is caused to generate bubbles when thermal energy is given by means of the heat generating device 12. In this respect, between the first liquid flow path 13 and the second liquid flow path 14, a movable separation film 15 is arranged to separate them from each other. Here, the movable separation film 15 and the orifice plate 19 are closely fixed with each other. As a result, there is no possibility that liquids in each of the flow paths are allowed to be mixed.

Figure 3A:
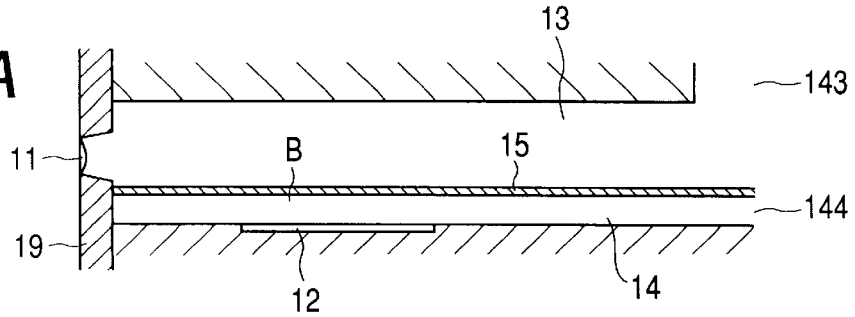
FIGS. 3A, 3B, 3C, 3D and 3E are cross-sectional views which illustrate the second example of a liquid discharging method to which the present invention is applicable, taken in the flow direction therein.

In the initial state shown in FIG. 3A, liquid in the first liquid flow path 13 is sucked nearer to the discharge opening 11 by means of the attraction of the capillary tube as in FIG. 2A. Here, in accordance with the present example, the discharge opening 11 is positioned on the downstream side in the direction of the liquid flow with respect to the projection area of the heat generating device 12 to the first liquid flow path 13.

Figure 3B:
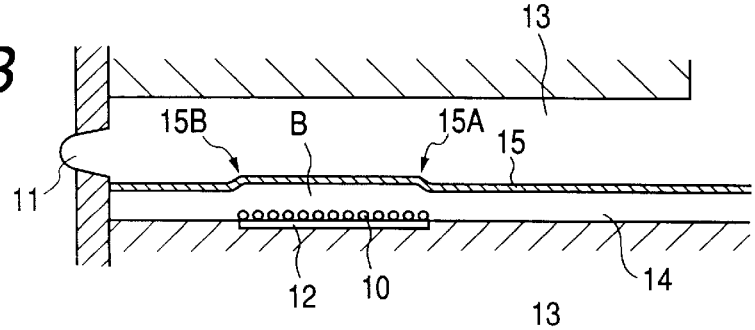

In this state, when thermal energy is given to the heat generating device 12 (for the present example, a heat generating resistor in the shape of 40 μm×115 μm), the heat generating device 12 is heated abruptly. The surface thereof, which is in contact with the second liquid in the air bubble generating area B gives heat to the liquid to generate bubbles (FIG. 3B). The air bubble 10 thus created by the heat bubble generation is an air bubble created on the basis of such film boiling as disclosed in the specification of U.S. Pat. No. 4,723,129. It is created on the entire surface of the heat generating device at a time accompanied by extremely high pressure. The pressure thus exerted at that time becomes pressure waves to propagate the second liquid in the second liquid flow paths 14, hence acting upon the movable separation film 15. In this manner, the movable separation film 15 is displaced to initiate the discharge of the second liquid in the first liquid flow path 13.

Figure 3C:
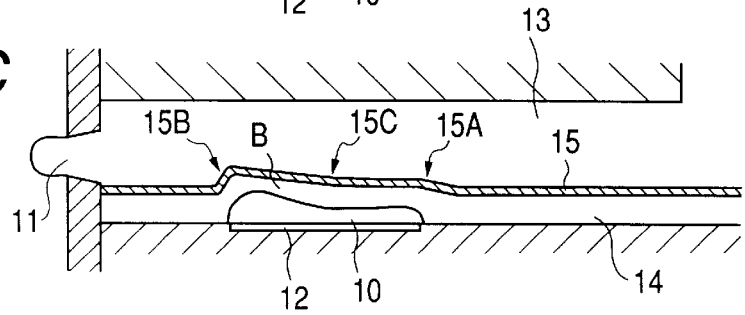

The air bubble 10 created on the entire surface of the heat generating device 12 is developed rapidly to present itself in the form of film (FIG. 3C). The expansion of the air bubble 10 brought about by the extremely high pressure exerted in the initial stage causes the movable separation film 15 to be further displaced. In this manner, the discharge of the first liquid in the first liquid flow path 13 from the discharge opening 11 is in progress. At this juncture, as shown in FIG. 3C, the portion of the movable separation film 15 in the movable region is displaced larger relatively on the downstream side at 15B from the initial stage than the portion thereof on the upstream side at 15A. In this way, the first liquid in the first liquid flow path 13 is efficiently moved to the discharge opening 11 side even from the initial stage.

Figure 3D:
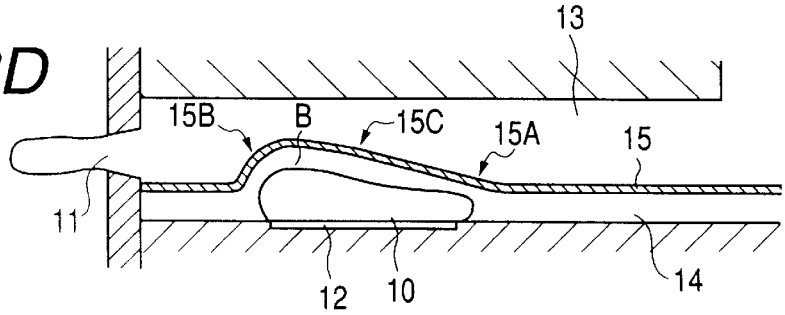

After that, when the air bubble 10 is further developed, the displacement of the movable separation film 15 and the development of the air bubble are promoted from the state shown in FIG. 3C. Along with this promotion, the displacement of the movable separation film 10 is displaced larger still (FIG. 3D). Particularly, the displacement of the movable separation film 10 on the portion on the downstream side at 15B becomes greater than the displacement of the portion on the downstream side at 15A and the central portion at 15C. Therefore, the movement of the first liquid in the first liquid flow path 13 is accelerated in the direction toward the discharge opening directly, while the displacement of the portion on the upstream side at 15A is smaller in the entire process. As a result, the movement of liquid is smaller in the direction toward the upstream side.

In this way, it becomes possible to enhance the discharge efficiency, particularly the discharge speed, and to produce favorable effect on the liquid refilling in the nozzles, and the voluminal stabilization of the discharge droplets as well.

Figure 3E:
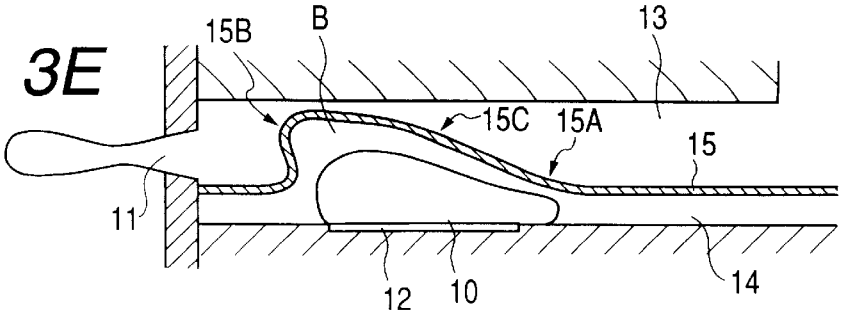

After that, when the air bubble 10 is further developed, the portions of the movable separation film 15 on the downstream side at 15B and in the central portion at 15C are displaced and stretched further in the direction toward the discharge opening side. In this manner, the enhancement of the above-mentioned effects, namely, the discharge efficiency and the discharge speed, are implemented (FIG. 3E). Here, in particular, the displacement and stretching are made greater not only with respect to the sectional configuration of the movable separation film 15, but also, to the width direction of the liquid flow path. Therefore, the acting area, in which the first liquid in the first liquid flow path 13 is in the direction toward the discharge opening, becomes larger, hence making it possible to enhance the discharge efficiency synergically. Here, the displacement configuration of the movable separation film 15 resembles the shape of human nose. Thus, this is called "nose type". Also, it is to be understood that as shown in FIG. 3E, the nose type includes the "S-letter type" where the point B positioned on the upstream side in the initial stage is allowed to be positioned on the downstream side of the point A positioned on the downstream side in the initial stage, as well as the configuration where as shown in FIG. 2E, the points A and B are equally positioned.

(Example of the Displacement of the Movable Separation Film)

Figure 4A:
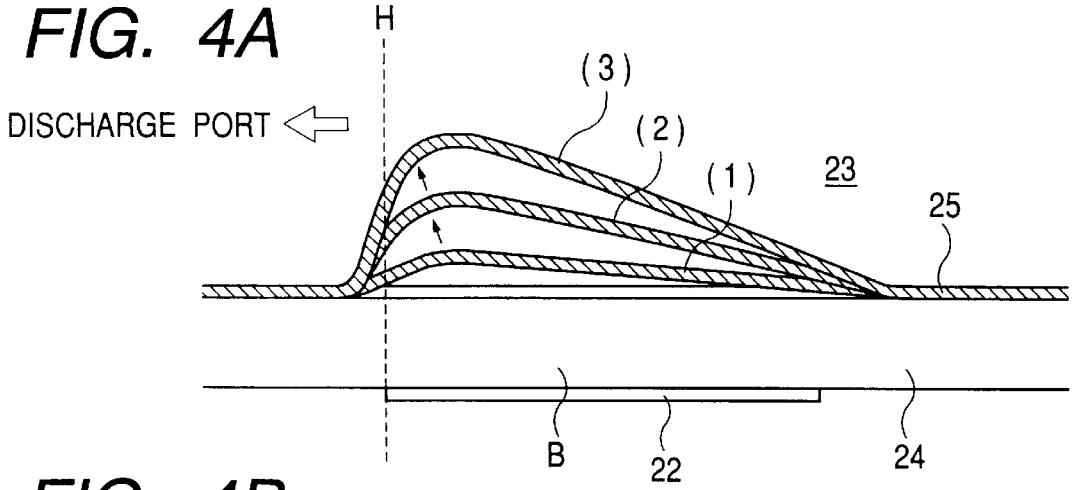
FIGS. 4A, 4B and 4C are cross-sectional views which illustrate the displacement process of a movable separation film in accordance with the liquid discharging method of the present invention, taken in the flow direction therein.
Figure 4B:
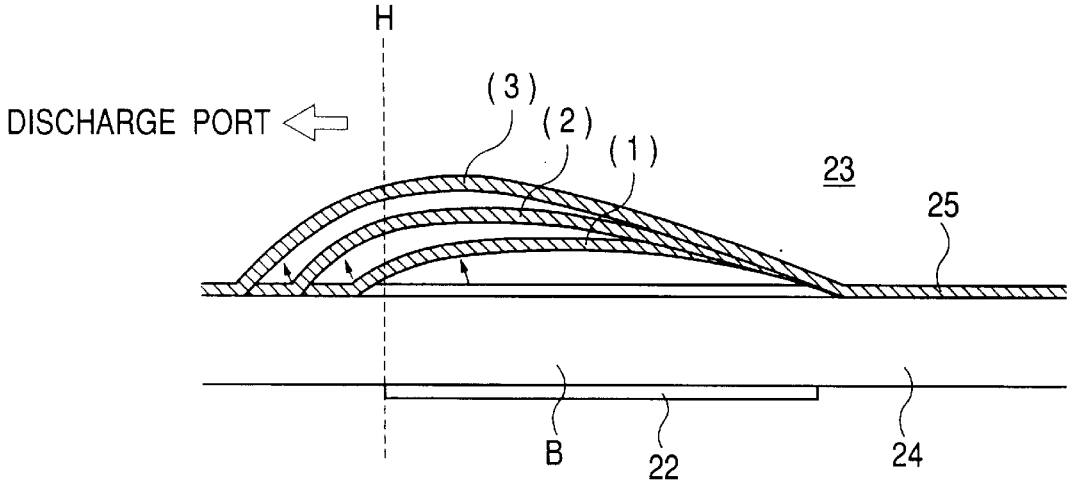
Figure 4C:
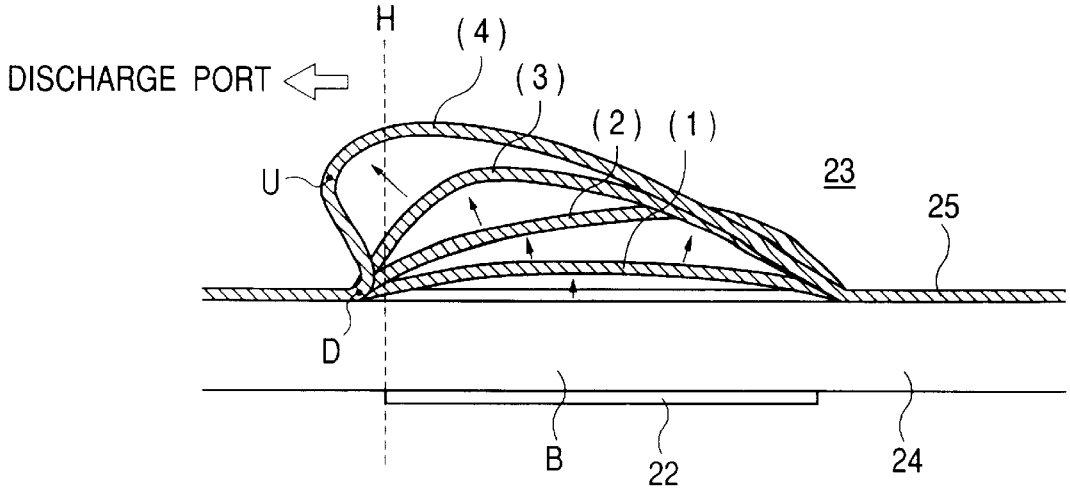

FIGS. 4A to 4C are cross-sectional views which illustrate the displacement process of the movable separation film for the liquid discharging method applicable to the present invention, taken in the direction of flow path thereof.

In this respect, the description will be made by giving attention particularly to the movable range and the displacement changes of the movable separation film, and the provision of figures of the air bubble, the first liquid flow path, and the discharge opening will be omitted. However, in any one of FIGS. 4A to 4C, the fundamental structure is arranged in such a manner that the vicinity of the projection area of the heat generating device 22 is the air bubble generating area B in the second liquid flow path 24, and that the second liquid flow path 24 and the first liquid flow path 23 are separated essentially by means of the movable separation film 25 at all times during the period of displacement from the initial stage. Also, with the end portion of the heat generating device 22 (indicated by line H in FIGS. 4A to 4C) serving as the boundary, the discharge opening is arranged on the downstream side, and the supply unit of the first liquid is arranged on the upstream side. Here, the term "upstream side" and the term "downstream side" referred to in the present example and on are meant to describe the direction of liquid flow in the flow path, observed from the central portion of the movable range of the movable separation film.

In FIG. 4A, the movable separation film 25 is displaced in order of (1), (2), and (3) from the initial state, and there provided from the initial stage the process in which the downstream side is displaced larger than the upstream side. This process, in particular, makes it possible to enhance the discharge efficiency, and at the same time, to implement the enhancement of discharge speed, because it can act upon the displacement on the downstream side to push out the first liquid in the first liquid flow path 23 in the direction toward the discharge opening side. Here, in FIG. 4A, it is assumed that the movable range described above is substantially constant.

In FIG. 4B, as the movable separation film 25 is displaced in order of (1), (2), and (3), the movable range of the movable separation film 25 is shifted or expanded to the discharge opening side. In this mode, the upstream side of the movable range is fixed. Here, the downstream side of the movable separation film 25 is displaced larger than the upstream side, and at the same time, the development of the air bubble itself is also made in the direction toward the discharge opening side. Therefore, the discharge efficiency is enhanced still more.

In FIG. 4C, the movable separation film 25 is displaced from the initial state indicated by the number (1) to the state indicated by the number (2) uniformly both the upstream and downstream sides or in condition that the upstream side is displaced slightly larger. However, when the air bubble is further developed from the state indicated by the number (3) to the number (4), the downstream side is displaced larger than the upstream side. In this way, the first liquid even in the upper part of the movable region can be moved in the direction toward the discharge opening side, hence enhancing the discharge efficiency, as well as increasing the amount of discharge.

Further, in FIG. 4C, the point U where the movable separation film 25 exists in the process indicated by the number (4) is displaced further on the discharge opening side than the point D positioned further on the downstream than the point U in the initial state. Therefore, the portion which is expanded and extruded into the discharge opening side makes it possible to enhance the discharge efficiency still more. Here, this configuration is called the "nose type" as described earlier.

The liquid discharging methods provided with the processes described above are applicable to the present invention. Each of the processes represented in FIGS. 4A to 4C is not necessarily adopted individually, but it is assumed that a process that contains the respective components is also applicable to the present invention. Also, the process that contains the nose type is not necessarily limited to the one represented in FIG. 4C. Such process may be introduced into the ones represented in FIGS. 4A and 4B. Also, the movable separation films used for the structure represented in FIGS. 4A to 4C may be such as to be provided with the sagged portions in advance irrespective of whether or not those are expandable. Also, the thickness of any one of the movable separation films shown in figures does not present any particular meaning in terms of dimensions.

Here, the "means for regulating direction" referred to in the specification hereof includes all the means that may result in the "displacement" defined in the application hereof. It is derived from the structure or characteristics of the movable separation film itself, and it uses at least one of the actions or arrangement relationships of the movable separation films with the air bubble generating areas, the relationships with the flow resistance on the circumference of the air bubble generating areas, the members that act upon the movable separation films directly or indirectly, or the members (means) for regulating the displacement or expansion of the movable separation films. Therefore, the invention hereof includes in the embodiments thereof a plurality (more than two) of means for regulating direction described above as a matter of course. However, in the embodiments that have been given below, there is no description as to any arbitrary combination of the plural means for regulating direction. Here, it is to be understood that the present invention is not necessarily limited to the embodiments described below.

Figure 5:
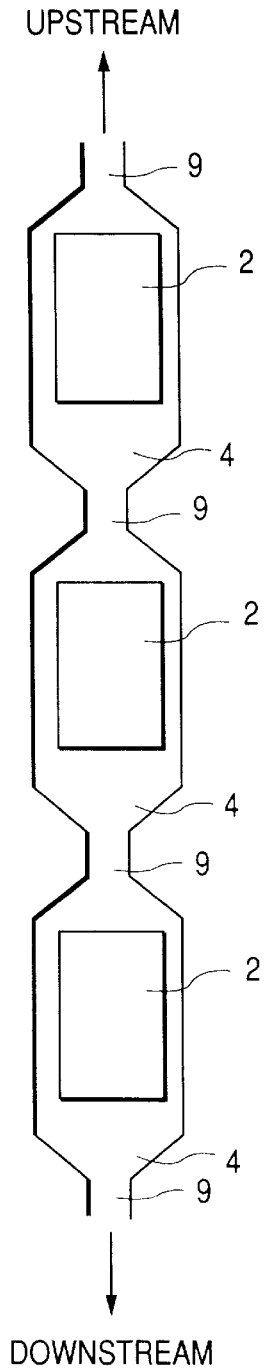
FIG. 5 is a view which illustrates one example of the arrangement relationship between heat generating devices and the second flow path of a liquid carrying apparatus.
Figure 6:
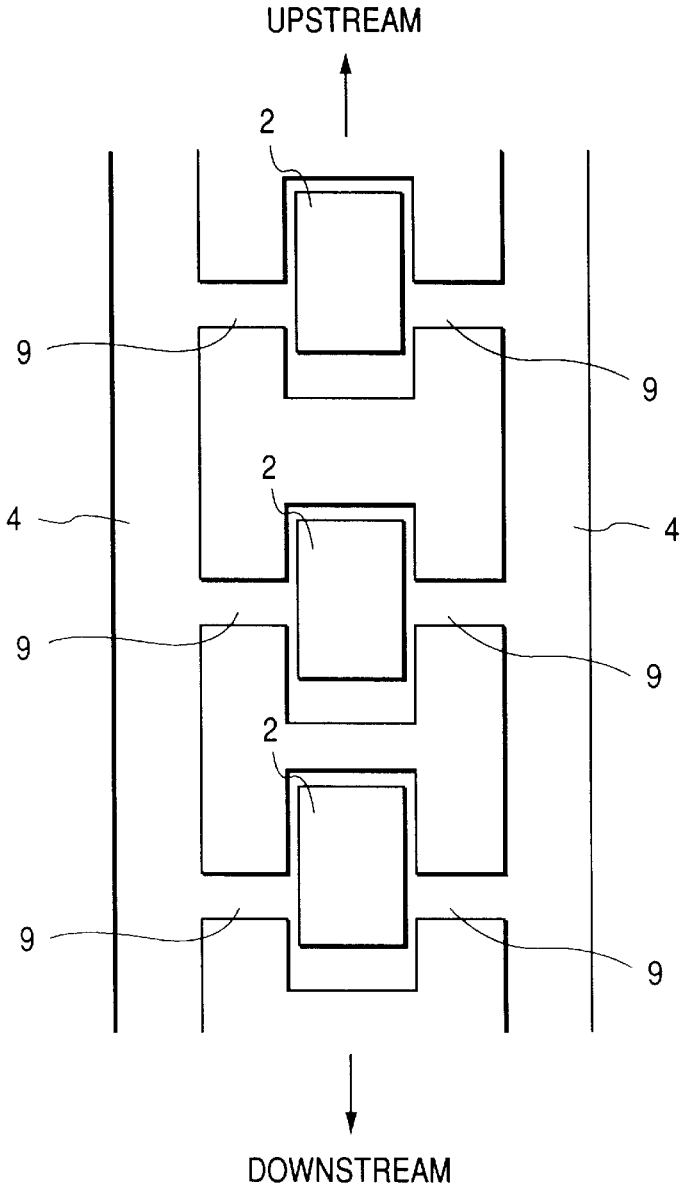
FIG. 6 is a view which illustrates another example of the arrangement relationship between heat generating devices and the second flow path of a liquid carrying apparatus.

FIG. 5 is a view which illustrates one example of the arrangement relationship between the heat generating devices and the second liquid flow path of the liquid carrying apparatus. As shown in FIG. 5, the shape of the second liquid flow path 4 is represented without the movable separation film 5, which is observed from above, and the space is arranged for each of the heat generating devices, respectively, to promote the development of each air bubble on the downstream side so that the movable separation film can be easily displaced on the downstream side. Each of the bottle necked portions becomes an aperture for supplying bubble generating liquid onto each of the heat generating devices in order to remove each of the remaining air bubbles. Also, FIG. 6 is a view which illustrates the arrangement relationship between the heat generating devices and the second liquid flow path of the liquid carrying apparatus whose structure is different from the one represented in FIG. 5. Here, the downstream side of liquid to be carried is on the lower part of either FIG. 5 and FIG. 6.

As shown in FIG. 5, each of the bottle necked portions 9 is installed in front and back of each of the heat generating devices 2 in the second liquid flow path 4, which is structured like a chamber (for generating bubbles) arranged to suppress the escape of pressure generated at the time of generating bubbles to the adjacent heat generating device 2 by way of the second liquid flow path 4. Here, in accordance with the present embodiment, the structure is arranged to guide the supply of bubble generating liquid underneath the movable separation film 5 as in the supply of carrying liquid. However, the present invention is not necessarily limited to this structural arrangement. If there is no problem even if the side width is made slightly larger in the direction of liquid flow, it may be possible to arrange the structure with the liquid flow paths dedicated to the use of bubble generating liquid together with the liquid flow paths branched out from them and led to each of the chambers for generating bubbles as shown in FIG. 6. In this case, too, each of the bottle necked portions 9 is installed on both side of each heat generating device 2, and the structure should be arranged to prevent the pressure from escaping to both sides.

Figure 7:
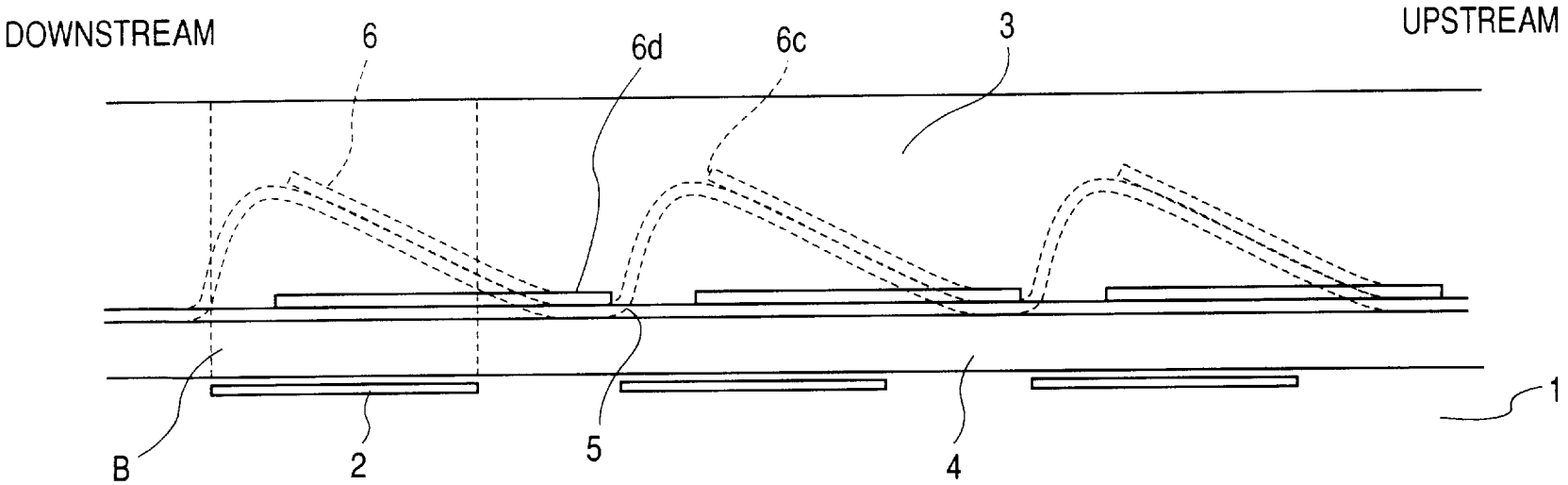
FIG. 7 is a cross-sectional view schematically showing the structure of the second embodiment of a liquid discharge head in accordance with the present invention.
Figure 8:
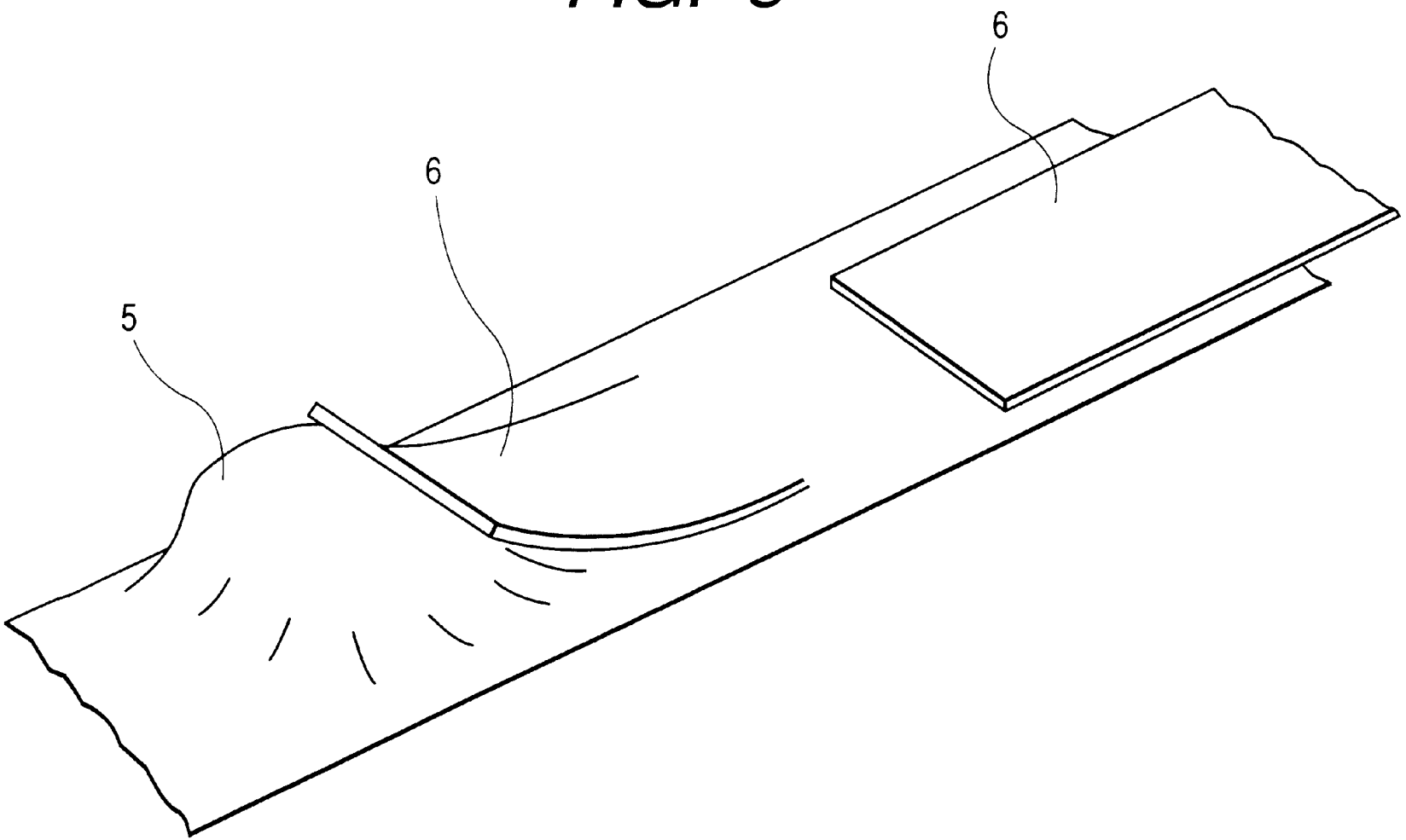
FIG. 8 is an external view which shows the state at the time of carriage in accordance with the second embodiment of the present invention.

FIG. 7 is a cross-sectional view schematically showing the liquid carrying apparatus in accordance with a second embodiment of the present invention, taken in the direction of the flow path thereof. The solid lines indicate the state when liquid carriage is at rest. The dotted lines indicate the state when liquid is carried. FIG. 8 is an external view which shows the state at the time of liquid carriage.

As shown in FIG. 7, the present embodiment is provided with the second liquid flow path 4 for use of bubble generating liquid on the substrate 1 where a plurality of heat generating devices (three devices are shown in FIG. 7, each formed by a heat generating resistor of 40 $\mu$m×105 $\mu$m in accordance with the present embodiment) which gives thermal energy to liquid for creating air bubble, respectively. On the second flow path, the first flow path 3 is arranged for liquid carriage. Also, between the second flow path 4 and the first flow 3, there is arranged a movable separation film 5 formed by a thin elastic film so as to separate the liquid residing on the first liquid flow path 3 for carriage, and the bubble generating liquid residing on the second liquid flow path 4.

For the movable separation film 5 positioned in the projection area above the surface of each heat generating device 2, the pressure direction control member 6, which is provided with its free end 6*c* on the downstream side, is arranged to face the heat generating device 2. As described later, the pressure direction control member 6 is displaced to the first liquid flow 3 side by the bubble generation of bubble generating liquid, and at the same time, it operates so that the deformation of the movable separation film becomes larger. The pressure direction control member 6 may be formed by the same material as the one used for the movable separation film 5 or may be formed by metal.

Also, the pressure direction control member is provided with a fulcrum point 6*d* on the upstream side of the liquid flow running from the supply chamber (not shown) to the downstream side by the carrying operation of liquid. This member is arranged in a position to face the heat generating device 2 away from it by a gap of approximately 10 $\mu$m to 15 $\mu$m in a state to cover the heat generating device 2. Here, the gap between the heat generating device 2 and the movable separation film 5 becomes the air bubble generating area B.

When the heat generating device 2 is energized to generate the heat that acts upon the bubble generating liquid in the air bubble generated area formed between the movable separation film 5 and the heat generating device 2, each of the air bubbles is created in the bubble generating liquid on the basis of the film boiling phenomenon such as disclosed in the specification of U.S. Pat. No. 4,723,129. The pressure exerted by the created air bubble acts upon the movable separation film preferentially, and as shown in FIG. 7, the movable separation film 5 is displaced to enable the pressure direction control member to open largely on the downstream side. In this manner, each of the air bubbles created in the air bubble generating area B is guided to the downstream side.

Now, hereunder, the detailed description will be made of the carrying operation of the liquid carrying apparatus which is structured as described above.

FIGS. 9A to 9D are cross-sectional views which illustrate the operation of the liquid carrying apparatus.

Figure 9A:
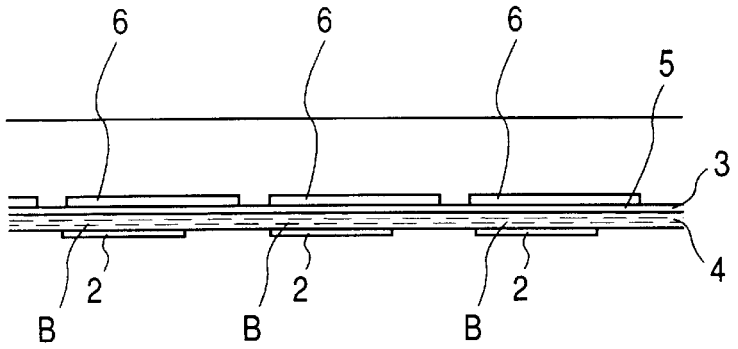
FIGS. 9A, 9B, 9C and 9D are cross-sectional views which illustrate the operation in accordance with the second embodiment of the present invention.

In FIG. 9A, none of energy, such as electric energy, is applied to any one of the heat generating devices 2 at all. No heat is generated by any one of the heat generating devices 2. Here, the pressure direction control member 6 is in the first position which is substantially in parallel with the substrate 1.

What is important here is that the pressure direction control member 6 is arranged up to the position to face at least the portion of the air bubble on the downstream side, which is created by the application of heat generated by the heat generating device 2. In other words, the pressure direction control member 6 is arranged in the structure of the liquid flow path at least up to the downstream position of the area center of the heat generating device 2 (that is, the downstream of the line orthogonal to the longitude direction of the flow path, which runs through the area center of the heat generating device 2).

Now, when electric energy or the like is applied to the heat generating device 2 (in the right-hand end in FIG. 9B), the heat generating device 2 is heated to give heat to a part of the bubble generating liquid which is filled in the air bubble generating area B, thus creating an air bubble 10 following film boiling. When the air bubble 10 is created, the movable separation film 5 and the pressure direction control member 6 arranged on it are displaced by the pressure thus exerted by the created air bubble 10 from the first position to the first liquid flow path 3 side in order to guide the propagating direction of the pressure exerted by the air bubble 10 in the downstream (carrying) direction.

Here, as described earlier, what is important is that the movable separation film 5 and the free end 6*c* of the pressure direction control member 6 are arranged on the downstream side, while the fulcrum point 6*d* is positioned on the upstream side (supply side), and that at least a part of the pressure direction control member 6 is allowed to face the downstream portion of the heat generating device 2, that is, to face the downstream portion of the air bubble 10.

Figure 9B:
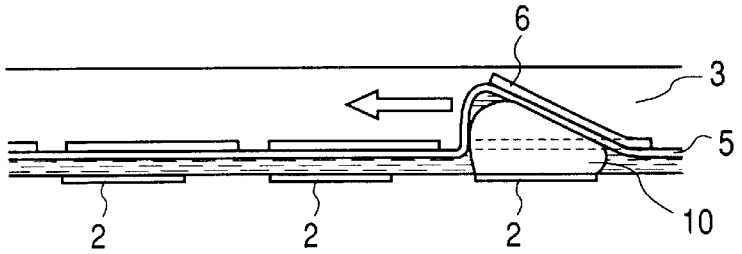
Figure 9C:
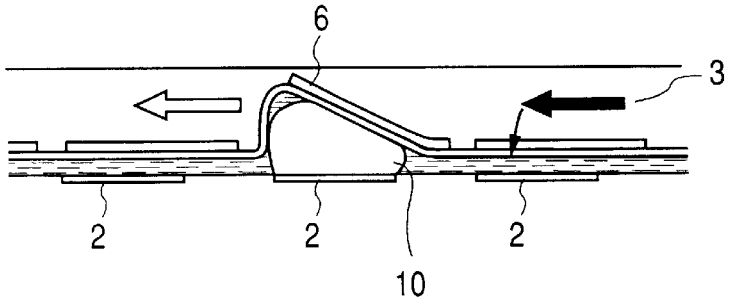

When the air bubble 10 is further developed, the pressure direction control member 6 on the movable separation film 5 is displaced more to the first liquid flow path 2 side in accordance with the pressure exerted by the created air bubble. Along with this displacement, the movable separation film on the free end side is largely expanded in the downstream direction. As a result, the created air bubble 10 is developed larger on the downstream side than the upstream side. The pressure direction control member 6 is largely displaced from the first position (dotted line) to the second position (FIG. 9B). FIG. 8 is an external view which represents this state. In this way, along with the development of the air bubble 10, the pressure direction control member 6 on the movable separation film 5 is gradually displaced to the first liquid flow path 3 side. Thus, the air bubble 10 on the free end side is developed so that the movable separation film is largely expanded in the downstream side. The pressure exerted by the created air bubble 10 is then directed in the downstream direction. In this manner, the carrying efficiency of the liquid in the first liquid flow path 3 is enhanced. Here, the movable separation film 5 presents almost no obstacle in propagating the bubble generation pressure in the downstream direction. Depending on the size of pressure to be propagated, it is possible to control the propagating direction of pressure and developing direction of air bubble 10 efficiently.

Figure 9D:
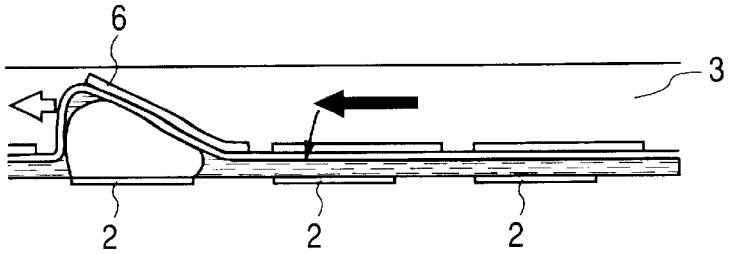

After that, when the application of energy to the heat generating device 2 is suspended, the air bubble 10 is contracted rapidly due to the reduction of inner pressure in the air bubble, which is characteristic of the film boiling phenomenon described earlier. Then, the pressure direction control member 6 on the movable separation film 5, which has been displaced up to the second position, returns to the initial position (the first position) as shown in FIG. 9A by the restoring force exerted by the contraction of the air bubble 10 and the springing property of the movable separation film 5 (FIG. 9D).

Also, at the time of bubble disappearance, liquid is allowed to flow in from the upstream side, namely, the liquid supply side, and also, from the downstream side in order to compensate the voluminal portion of the liquid which has been flown out.

Thus, one cycle of the operation of one heat generating device is completed. Such operation is conducted repeatedly for a plurality of heat generating devices one after another in order of the flow from the upstream side to the downstream side as shown in FIGS. 9A to 9D. This repeated operation makes it possible to carry liquid in the first liquid flow path 3 from the upstream side to the downstream side sequentially.

Also, by changing the sequential driving speed for the heat generating devices, it becomes possible to change the displacement timings of the pressure direction control members, hence making the amount of carriage or the like variable.

Now, the description will be made of the liquid carrying apparatus in accordance with a third embodiment of the present invention.

Figure 10A:
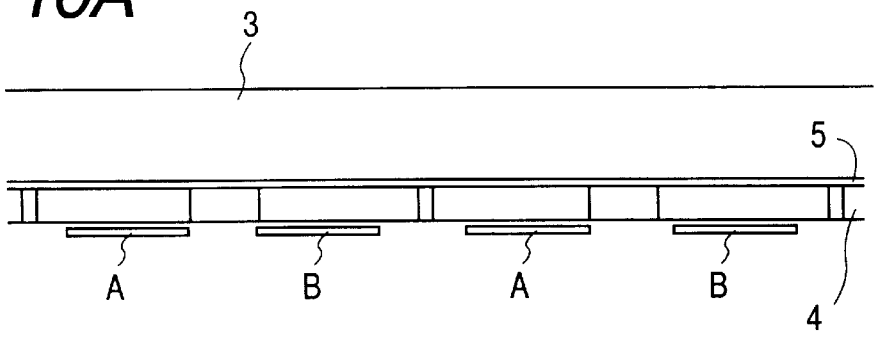
FIGS. 10A, 10B and 10C are cross-sectional views which illustrate the structure and operation of a third embodiment in accordance with the present invention.
Figure 10B:
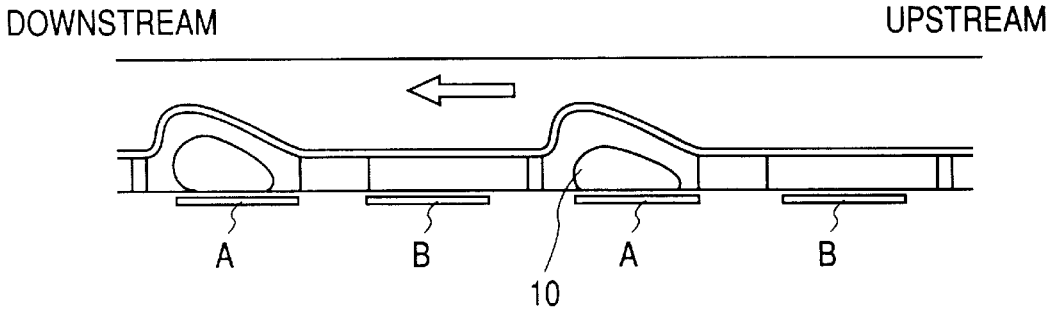
Figure 10C:
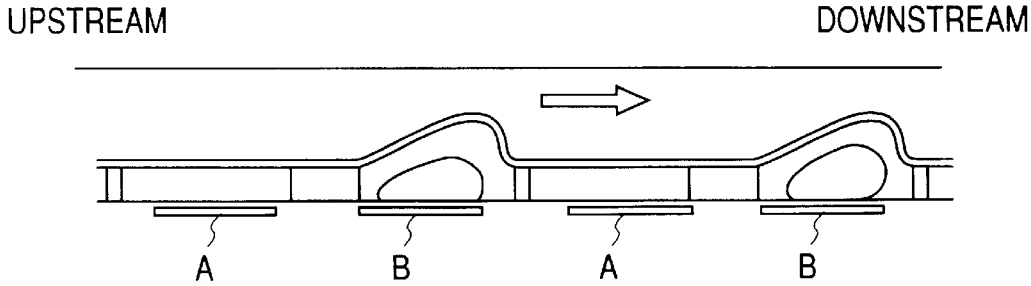

FIGS. 10A to 10C are views which illustrate the structure and the operation of the liquid carrying apparatus in accordance with the third embodiment.

In accordance with the third embodiment, it is possible to carry liquid in either directions of the liquid flow path 3 to the left and right. As shown in FIG. 10A, the heat generating devices A and B that constitute two groups are arranged alternately to form the structure of the third embodiment.

As to the carrying operation, when liquid should be carried in the direction indicated by an arrow in FIG. 10B, the heat generating devices of the group A are energized one after another to generate heat from the upstream side in the direction indicated by that arrow. Also, when liquid should be carried in the direction indicated by an arrow in FIG. 10C, the heat generating devices of the group B are energized one after another to generate heat from the upstream side in the direction indicated by that arrow. In this way, by selecting heat generating devices A or B for the two groups for the heat generation, it becomes possible to carry liquid in either directions to the left and right.

The present embodiment is applicable to the liquid discharge head, but it is also usable for carrying such liquid as oily liquid or gasoline which is easily affected by heat, because the directions of liquid carriage are switchable.

Also, the present embodiment of the invention hereof is arranged to be able to switch the directions of liquid carriage alternately in a short period of time or at an appropriate sequence and timing. As a result, this embodiment can be used for agitating liquid, and it may produce particular effect on the liquid that needs agitation. Since the structure, which is arranged to change directivities simply, makes it possible to change status of liquid as required. Therefore, the range of such structure is not necessarily limited. It is anticipated that the application value of such structure is significantly high.

Figure 11:
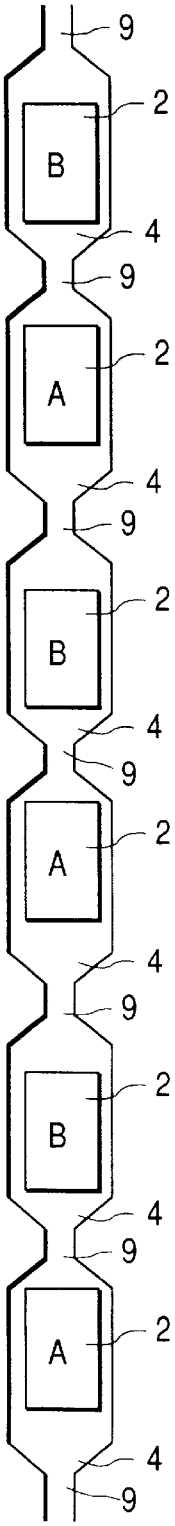
FIG. 11 is a view which illustrates one example of the arrangement relationship between the heat generating devices that form two groups, and the second flow path.
Figure 12:
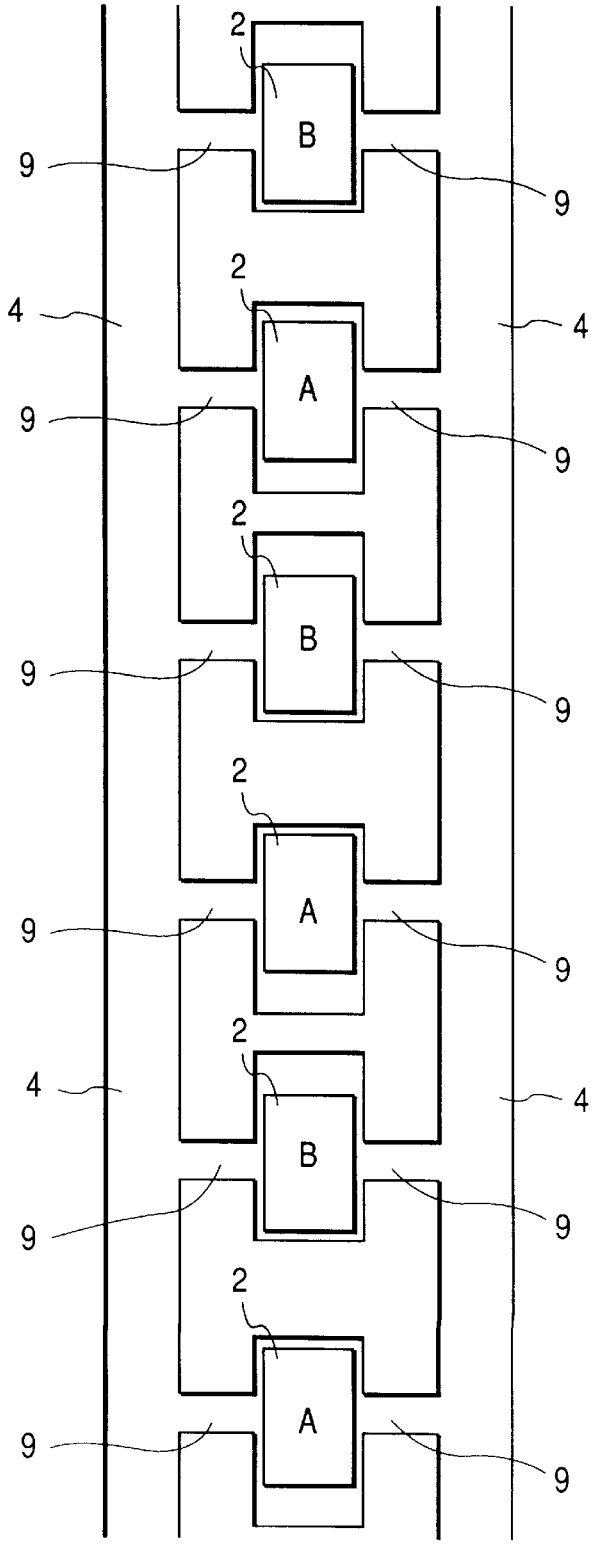
FIG. 12 is a view which illustrates another example of the arrangement relationship between the heat generating devices that form two groups, and the second flow path.

FIG. 11 is a view which illustrates one example of the arrangement relationship between the heat generating devices A and B that constitute two groups and the second liquid flow path of the liquid carrying apparatus. As shown in FIG. 11, the shape of the second liquid flow path 4 is represented without the movable separation film 5, which is observed from above, and the space is arranged for each of the heat generating devices A and B that constitute the two groups, respectively, to promote the development of each air bubble on the downstream side so that the movable separation film can be easily displaced on the downstream side. Each of the bottle necked portions becomes an aperture for supplying bubble generating liquid onto each of the heat generating devices in order to remove each of the remaining air bubbles. Also, FIG. 12 is a view which illustrates the arrangement relationship between the heat generating devices A and B that constitute two groups and the second liquid flow path of the liquid carrying apparatus whose structure is different from the one represented in FIG. 11. For this example, too, the shape of the second liquid flow path 4 is represented without the movable separation film 5, which is observed from above, and the space is arranged, respectively, for each of the heat generating devices A and B that constitute the two groups in order to promote the development of each air bubble on the downstream side so that the movable separation film can be easily displaced on the downstream side.

As shown in FIG. 11, each of the bottle necked portions 9 is installed in front and back of each of the heat generating devices 2 in the second liquid flow path 4, which is structured like a chamber (for generating bubbles) arranged to suppress the escape of pressure generated at the time of generating bubbles to the adjacent heat generating device 2 by way of the second liquid flow path 4. Here, in accordance with the present embodiment, the structure is arranged to guide the supply of bubble generating liquid underneath the movable separation film 5 as in the supply of carrying liquid. However, the present invention is not necessarily limited to this structural arrangement. If there is no problem even if the side width is made slightly larger in the direction of liquid flow, it may be possible to arrange the structure with the liquid flow paths dedicated to the use of bubble generating liquid together with the liquid flow paths branched out form them and led to each of the chambers for generating bubbles as shown in FIG. 12. In this case, too, each of the bottle necked portions 9 is installed on both side of each heat generating device 2, and the structure should be arranged to prevent the pressure from escaping to both sides.

Now, the description will be made of the liquid carrying apparatus in accordance with a fourth embodiment of the present invention.

Figure 13A:
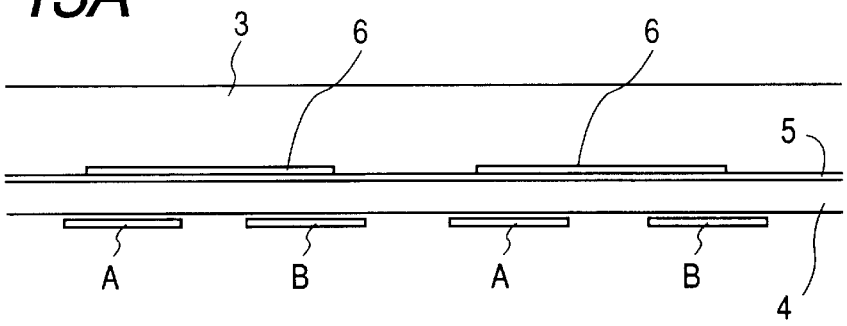
FIGS. 13A, 13B and 13C are cross-sectional views which illustrate the displacement process of the movable separation film in accordance with a fourth embodiment of the present invention.
Figure 13B:
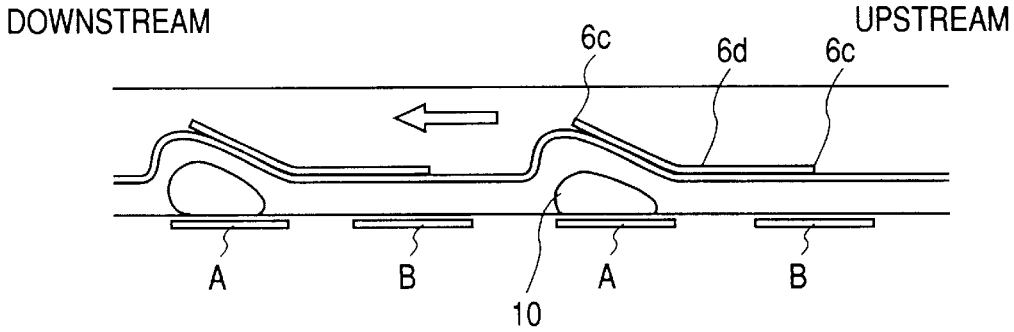
Figure 13C:
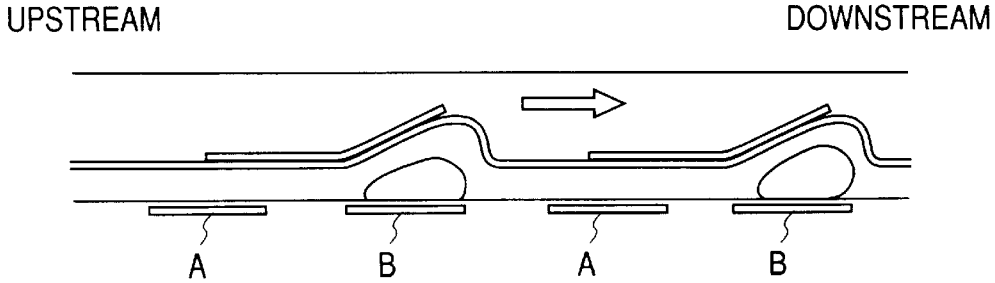

FIGS. 13A to 13C are views which illustrate the structure and the operation of the liquid carrying apparatus in accordance with the fourth embodiment.

In accordance with the fourth embodiment, it is possible to carry liquid in either directions of the liquid flow path 3 to the left and right in the same manner as in the third embodiment. As shown in FIG. 13A, the heat generating devices A and B that constitute two groups are alternately arranged on a substrate. Also, on the movable separation film 5, each of the pressure direction control members 6 is arranged with the mid point of the heat generating devices A and B as its fulcrum point 6*d*, while its free end 6*c* is arranged in a position which is beyond each of the area centers of the two heat generating devices.

Figure 14A:
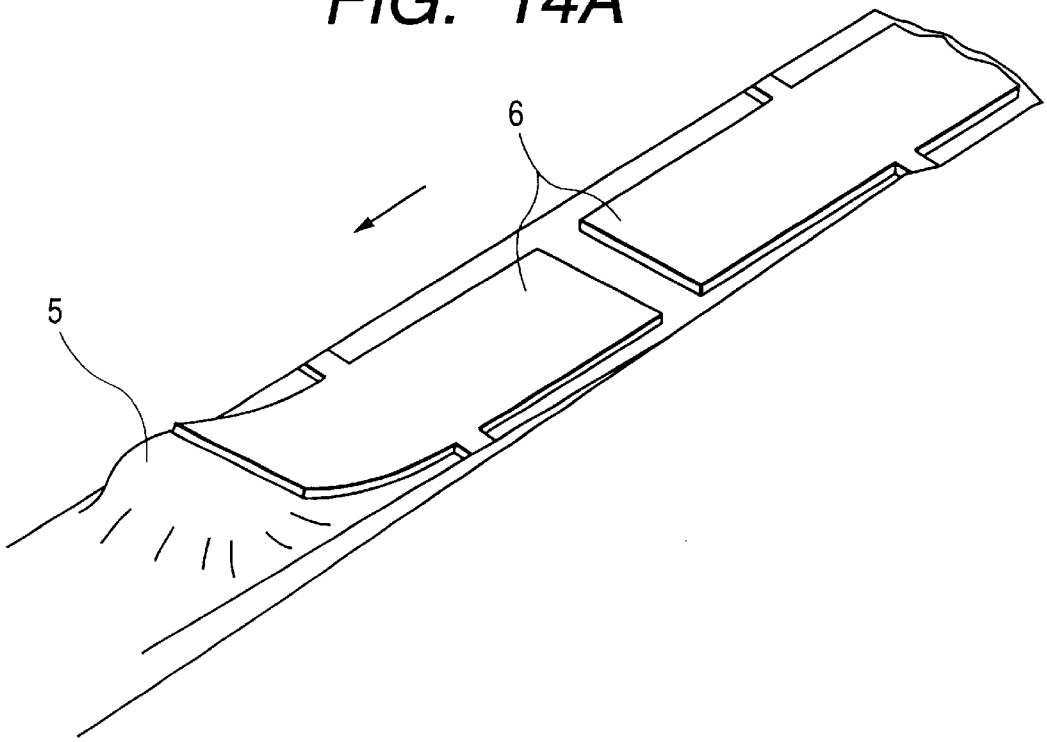
FIGS. 14A and 14B are external views which show the state at the time of carriage in accordance with the fourth embodiment of the present invention.
Figure 14B:
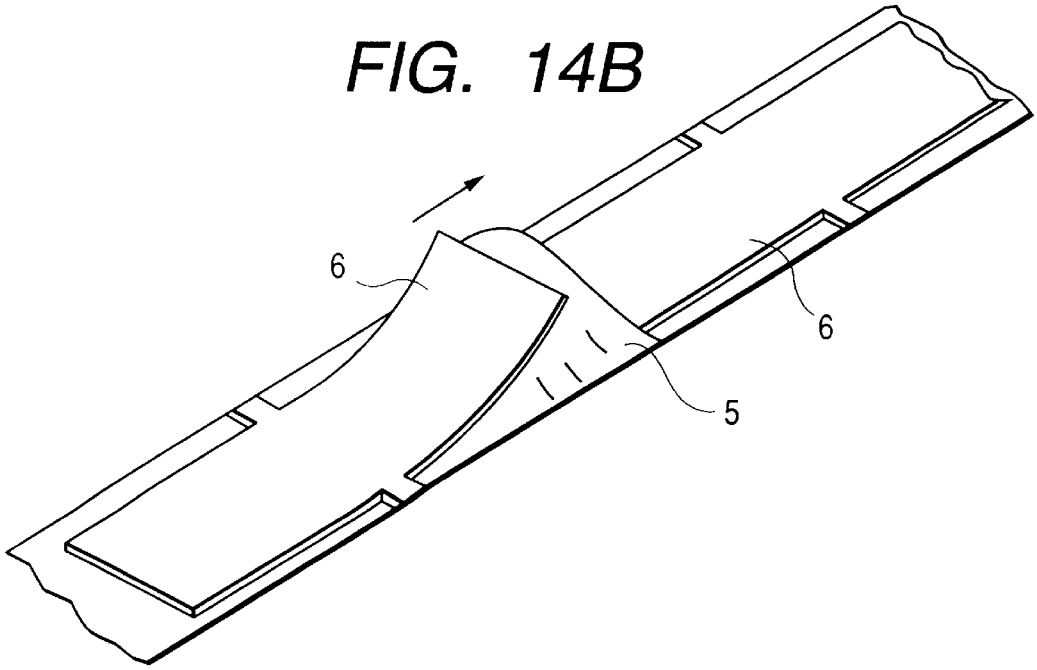

As to the carrying operation, when liquid should be carried in the direction indicated by an arrow in FIG. 13B, the heat generating devices of the group A are energized one after another to generate heat from the upstream side in the direction indicated by that arrow. Also, when liquid should be carried in the direction indicated by an arrow in FIG. 13C, the heat generating devices of the group B are energized one after another to generate heat from the upstream side in the direction indicated by that arrow. In this way, by selecting heat generating devices A or B for the two groups for the heat generation, it becomes possible to carry liquid in either directions to the left and right. FIGS. 14A and 14B are external views which illustrate the respective states of liquid carriage.

Now, the description will be made of the liquid carrying apparatus in accordance with a fifth embodiment in accordance with the present invention.

FIGS. 15A to 15E are cross-sectional views which illustrate the structure and operation of the liquid carrying apparatus in accordance with the fifth embodiment.

In accordance with the fifth embodiment, at the same time that the carrying liquid is carried, it is made possible to effectuate its refilling, as well as the bubble generating liquid carriage and its refilling. The movable separation film is then arranged so that its movable range becomes longer on the downstream side of each of the heat generating devices 2.

Figure 15A:
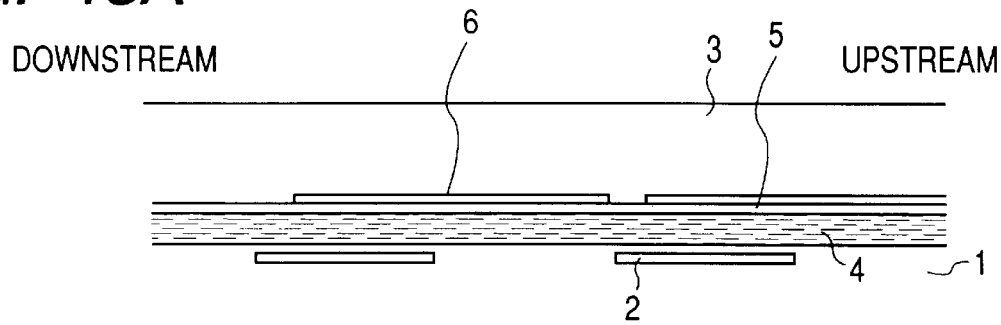
FIGS. 15A, 15B, 15C, 15D and 15E are cross-sectional views which illustrate the structure and operation of a fifth embodiment of the present invention.

In operating the liquid carriage and refilling, none of energy, such as electric energy, is applied any one of the heat generating devices 2 at all in the initial state as shown in FIG. 15A. No heat is generated by any one of the heat generating devices 2. Here, the pressure direction control member 6 is in the first position which is substantially in parallel with the substrate 1.

Figure 15B:
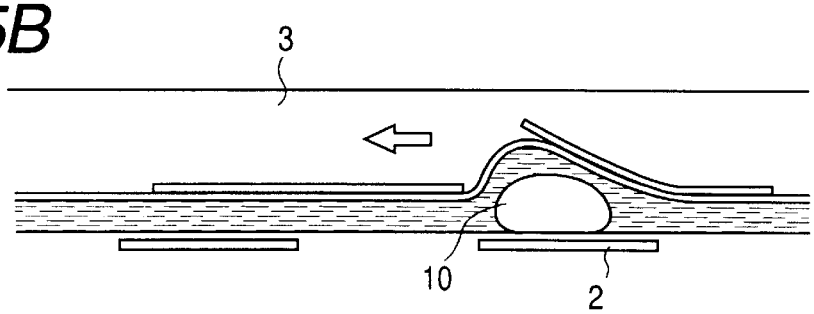

With generating bubbles by use of the heat generating device 2 on the upstream side, the liquid in the first liquid flow path 3 begins to flow in the direction indicated by an arrow shown in FIG. 15B.

Figure 15C:
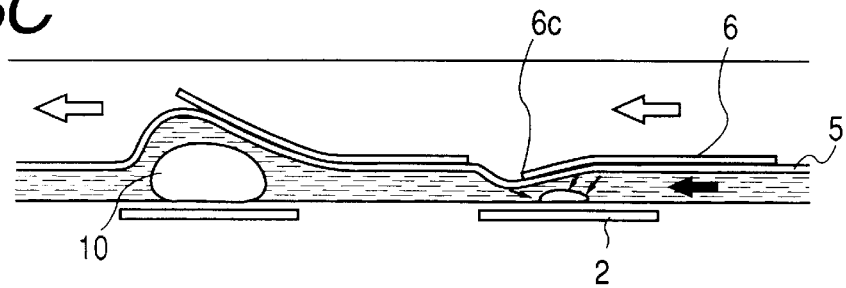

Then, with generating bubbles by use of the heat generating device 2 on the downstream side, the liquid in the first liquid flow path is further pushed to flow in the direction indicated by an arrow in FIG. 15C.

At this juncture, with respect to the heat generating device on the upstream side, the movable separation film 5 and the pressure direction control member 6 are displaced to the second liquid flow path 14 side beyond the initial position due to the bubble disappearance caused by the negative pressure. Then, on the circumference of the free end 6*c* of the pressure direction control member 6, the negative pressure is exerted locally. In this manner, assisting action is actuated to supply the carrying liquid from the supply side in the direction indicated by arrows shown in FIG. 15C. At the same time, liquid is sucked in onto the heat generating device from the bubble generating liquid supply side in the second liquid flow path 4 due to the negative pressure exerted by the bubble disappearance on the heat generating device.

Figure 15D:
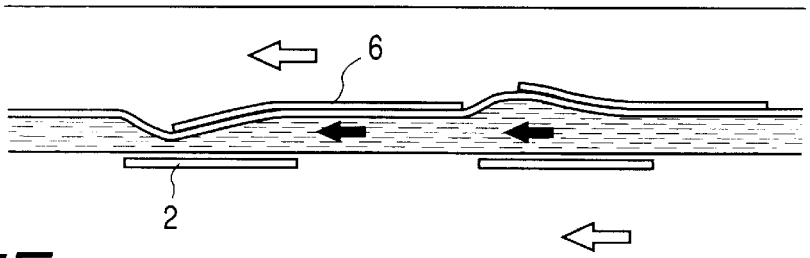
Figure 15E:
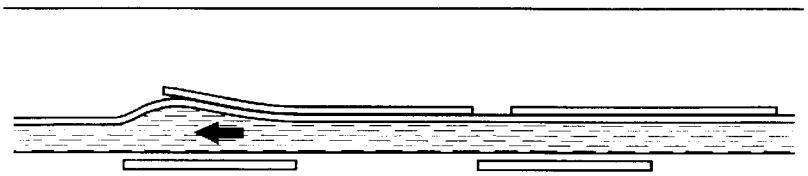
Figure 16A:
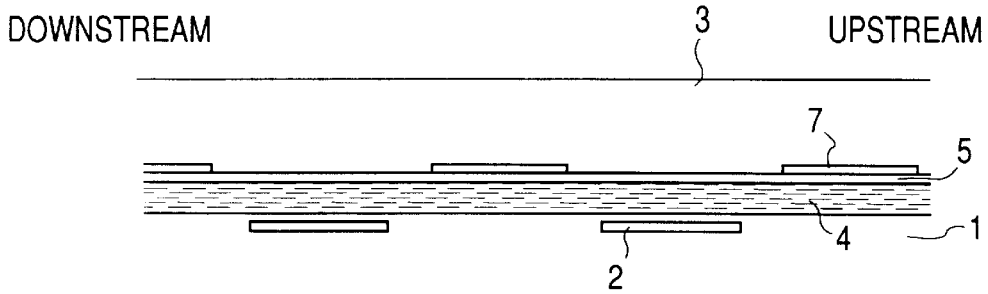
FIGS. 16A, 16B, 16C, 16D and 16E are cross-sectional views which illustrate the structure and operation of a sixth embodiment of the present invention.
Figure 16B:
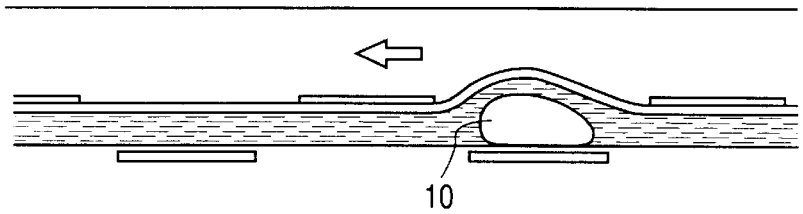
Figure 16C:
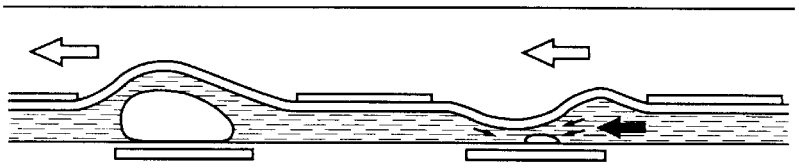
Figure 16D:
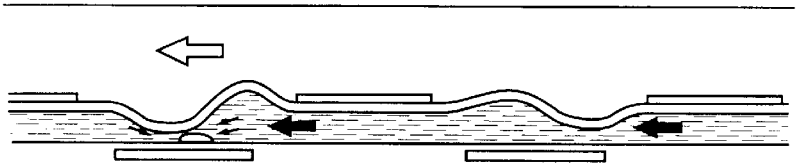
Figure 16E:
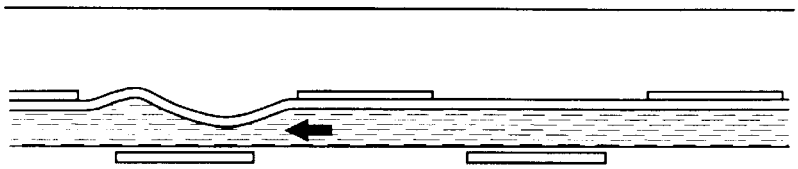
Figure 17A:
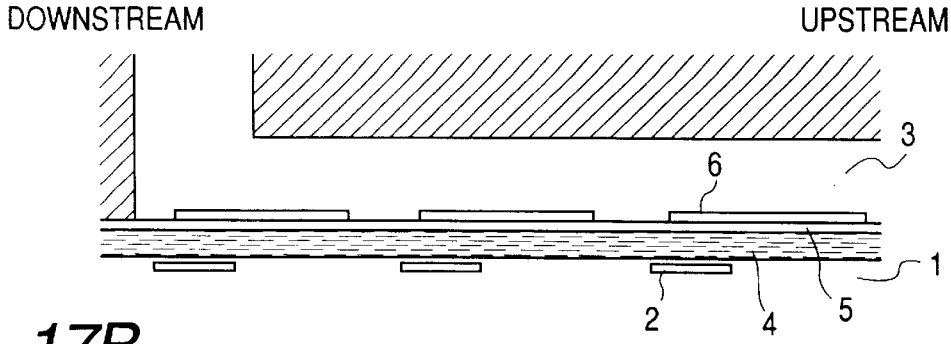
FIGS. 17A, 17B, 17C, 17D and 17E are cross-sectional views which illustrate the structure and operation of a seventh embodiment of the present invention.
Figure 17B:
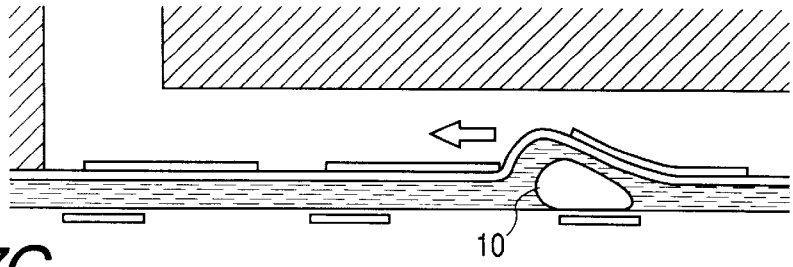
Figure 17C:
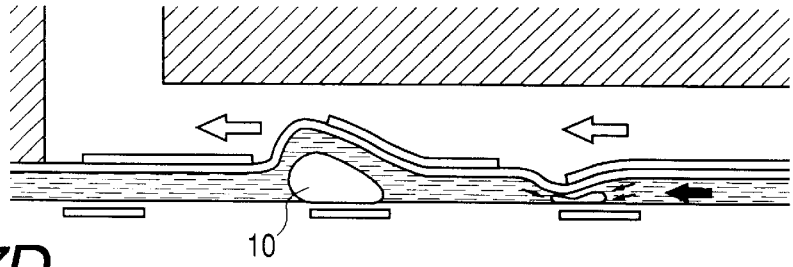
Figure 17D:
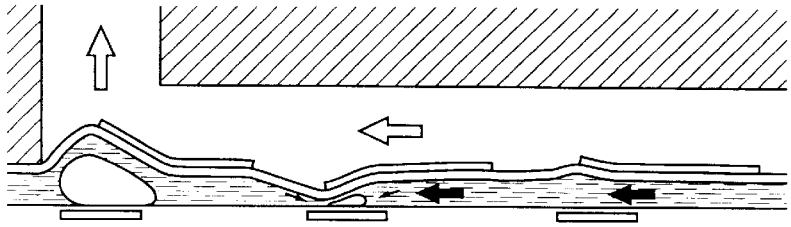
Figure 17E:
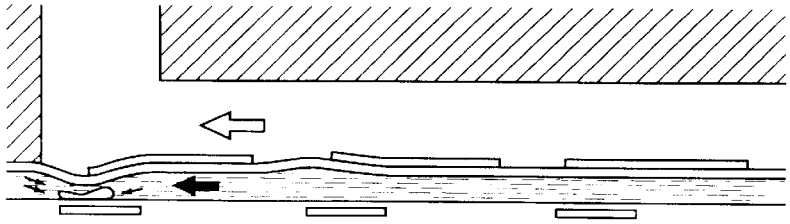
Figure 18A:
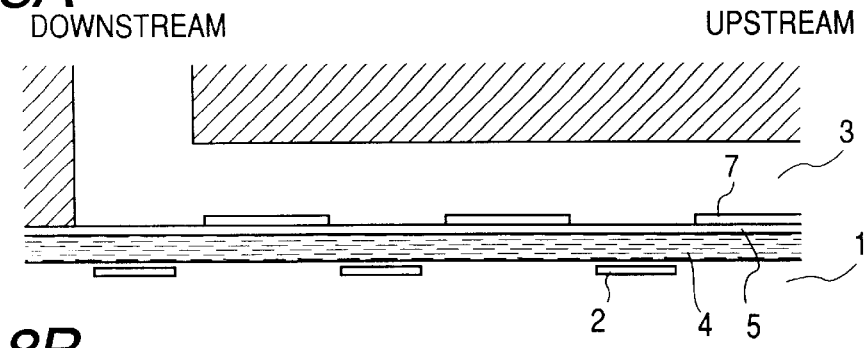
FIGS. 18A, 18B, 18C, 18D and 18E are cross-sectional views which illustrate the structure and operation of an eighth embodiment of the present invention.
Figure 18B:
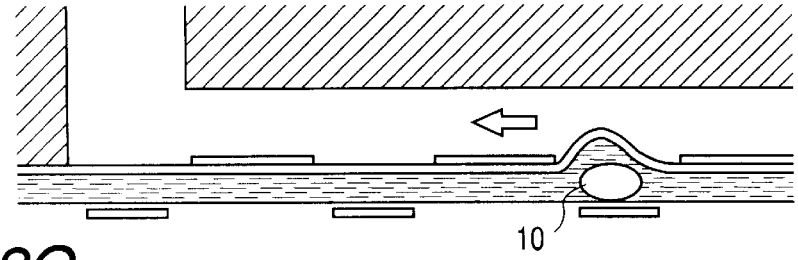
Figure 18C:
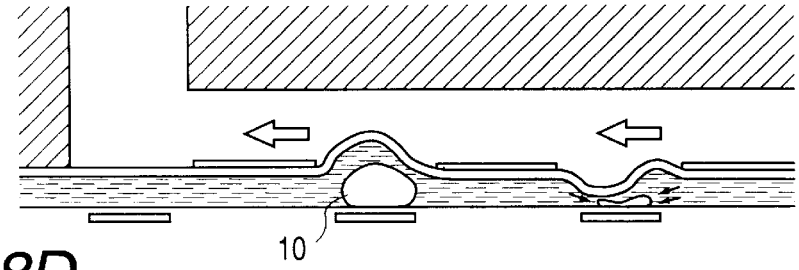
Figure 18D:
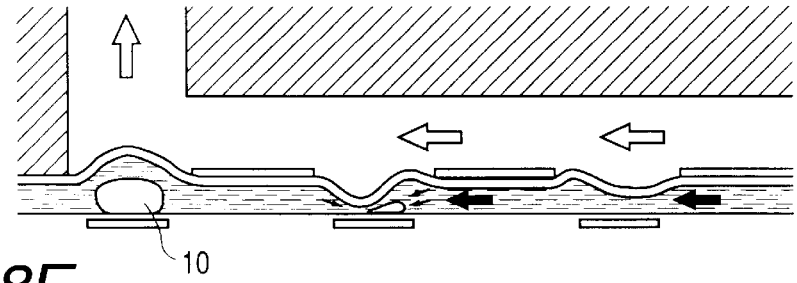
Figure 18E:
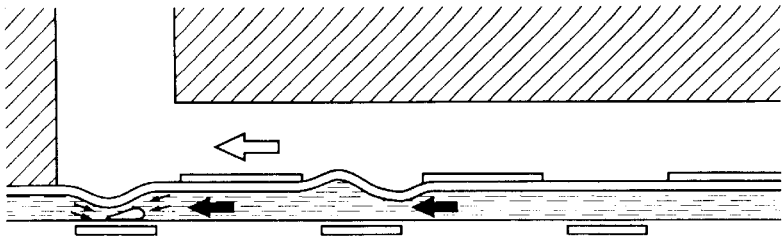
Figure 19A:
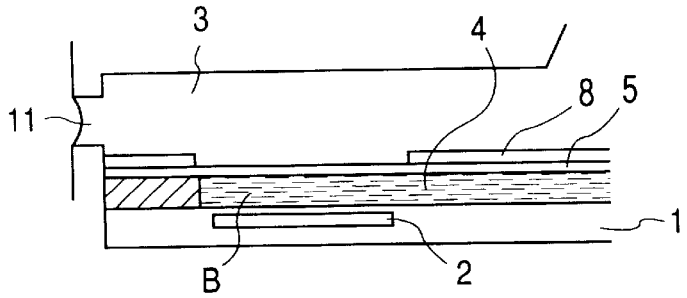
FIGS. 19A, 19B, 19C, 19D and 19E are cross-sectional views illustrating the structure and operation of a liquid discharge head (a ninth embodiment), which is one application example of the liquid carrying apparatus in accordance with the present invention.
Figure 19B:
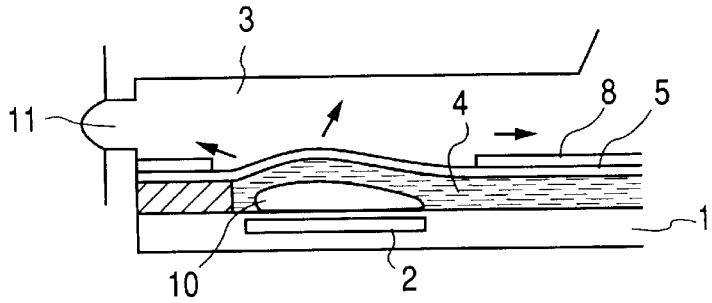
Figure 19C:
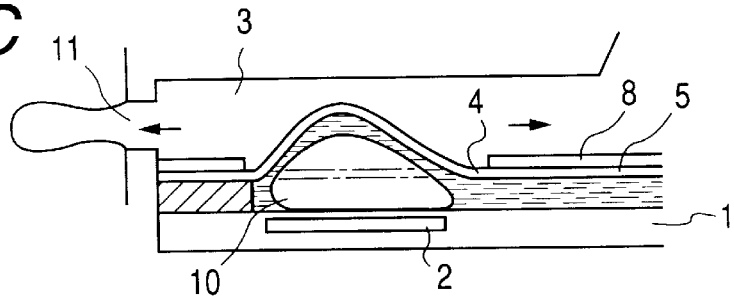
Figure 19D:
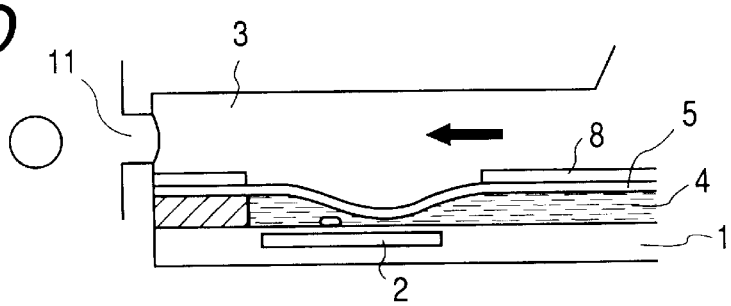
Figure 19E:
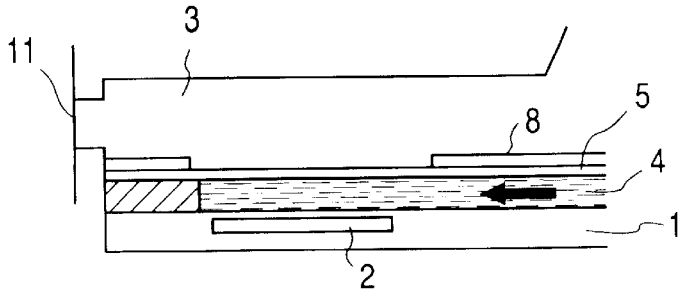

Also, on the circumference of the pressure direction control member 6 on the heat generating device 2 on the downstream side, the state of bubble disappearance takes place as shown in FIG. 15D in the same manner as in FIG. 15C. On the other hand, the pressure direction control member 6 on the upstream side repeats its vibrations until it returns to the initial state. At this juncture, the pressure direction control member and the movable separation film are slightly displaced to the first liquid flow path side. With fine negative pressure exerted at that time, the bubble generating liquid is further sucked in. After that, as shown in FIG. 15E, the process is restored to the initial state.

Here, in accordance with the present embodiment, the pressure direction control member is used, but it is still possible to operate the liquid carriage even without the pressure direction control member.

Now, the description will be made of the liquid carrying apparatus in accordance with a sixth embodiment of the present invention.

FIGS. 16A to 16E are cross-sectional views which illustrate the structure and operation of the liquid carrying apparatus in accordance with the sixth embodiment. In accordance with the sixth embodiment, upper displacement regulating members are used instead of the pressure direction control members used for the embodiments described so far.

An upper displacement regulating member 7 is not movable unlike the pressure direction control member that has been used up to now. However, giving attention to the material used for it, and the arrangement relationship with each of the heat generating devices as well, among some other factors, it is possible for this regulating member to provide the action which works effectively upon the guidance of the pressure exerted by the developed air bubble in the carrying direction as in the case of the pressure direction control member used for the embodiments up to now.

Now, the description will be made of the liquid carrying apparatus in accordance with a seventh embodiment of the present invention.

FIGS. 17A to 17E are cross-sectional views which illustrate the structure and operation of the liquid carrying apparatus in accordance with the seventh embodiment. In accordance with the seventh embodiment, the liquid flow path is bent in the displacement direction of the movable separation film positioned on the end portion thereof.

As clear from the descriptions of the operations of the embodiments so far, the liquid carrying apparatus is able to perform its function even when the liquid flow path is bent on its midway.

Here, in accordance with the present embodiment, the pressure direction control members are used. However, the liquid carriage is possible even without them.

Now, the description will be made of the liquid carrying apparatus in accordance with an eighth embodiment of the present invention.

FIGS. 18A to 18E are cross-sectional views which illustrate the structure and operation of the liquid carrying apparatus in accordance with the eighth embodiment. In accordance with the eighth embodiment, the upper displacement regulating members 7 are used for the seventh embodiment instead of the pressure direction control members. It is possible for the upper displacement regulating members to provide the action that works effectively upon the guidance of the pressure exerted by the developed air bubbles in the carrying direction as in the embodiments using the pressure direction control members.

As described above, with the structure arranged for the present embodiment, the carrying liquid and the bubble generating liquid are dealt with as different liquids, and the carrying liquid is carried by enabling the pressure exerted by the bubble generation of the bubble generating liquid to act upon each of the movable separation films 5. Therefore, a highly viscous liquid, such as polyethylene glycol, which cannot generate bubbles good enough easily even by the application of heat, may be carried in good condition in such a manner that this highly viscous liquid is supplied to the first liquid flow path 3, while a liquid that enables a bubble generating liquid to make good generating bubbles (such as a mixture of ethanol:water=4:6 in a quality of approximately 1 to 2 cp) is supplied to the second liquid flow path 4.

Also, as a bubble generating liquid, the liquid may be selected so that any burnt substance or deposit is accumulated on the surface of each of the heat generating devices when receiving heat. With the selection of such liquid, it becomes possible to stabilize generating bubbles and perform liquid carriage in good condition as well.

Further, with the apparatus structured in accordance with the present invention, it becomes possible to carry a highly viscous liquid or the like more efficiently under a higher pressure, because it can produce effects as has been described above for the present embodiment.

Also, when carrying the liquid whose property is weaker against heat, such liquid is supplied to the first liquid flow path 3 as the liquid to be carried, while a liquid whose property is not easily changeable by the application of heat, but performs good generating bubbles is supplied to the second flow path 4. In this manner, it becomes possible to carry such liquid efficiently under higher pressure as described above without causing any damage thermally to the liquid whose property is weaker against heat.

Now, with reference to the accompanying drawings, the detailed description will be made of the liquid discharge head using the liquid carrying apparatus described so far, which embodies the present invention.

(Ninth Embodiment)

FIGS. 19A to 19E are cross-sectional views of the liquid discharge unit of the liquid discharge head, which illustrate the structure and the operation of the embodiment applicable to it.

For the present embodiment, a reference numeral 11 designates a discharge opening that discharges liquid; 3, a first liquid flow path conductively connected with the discharge opening 11, in the first liquid flow path 3, the first liquid being filled to serve as a discharge liquid discharged from the discharge opening; 4, the second liquid flow path arranged adjacent to the first liquid flow path 3, which are separated by a movable separation film 5 at all times essentially. The separation member may be a film or a flat plate as far as the immovable portion is concerned. For the present embodiment, a separation wall 8 is used to separate all the areas other than the movable portions of each flow path. A reference numeral 2 designates a heat generating device that heats the second liquid to generate film boiling in it. There is an air bubble generating area B in the second liquid flow path where the air bubble is created by means of the film boiling thus generated.

The movable separation film 5 is provided with a movable region where it can be displaced to the first liquid flow path 3 side and to the second liquid flow path 4 side. The movable region faces at least a part of the air bubble generating area, and it is positioned on the downstream side with respect to the flow direction of the first liquid toward the discharge opening side.

Here, in accordance with the present embodiment, the discharge opening 11 is positioned on the downstream side of the movable region of the movable separation film 5. The movement of the portions other than the movable region of the movable separation film 5 is suppressed or fixed to the first and second liquid flow path sides. However, even if the movable region to the first liquid flow path 3 side is made different from that of the second liquid flow path 4 side, there is no problem if only the movable region to either sides is positioned on the downstream side of the area center of the air bubble generating area B.

(Tenth Embodiment)

FIGS. 20A to 20E are cross-sectional views of a nozzle, which illustrate the structure and operation of the liquid discharge head (particularly, those conditioned subsequent to the maximum generating bubbles).

Figure 20A:
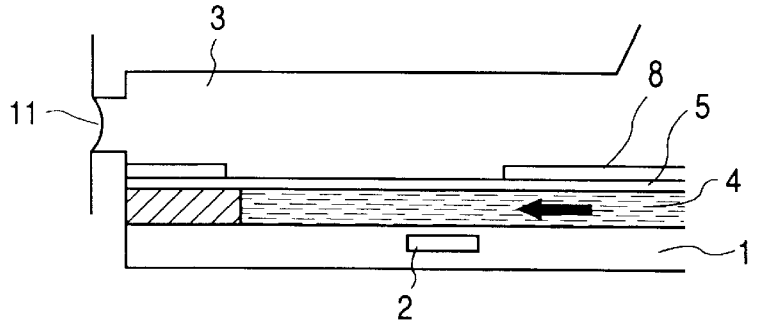
FIGS. 20A, 20B, 20C, 20D and 20E are cross-sectional views illustrating the structure and operation of a liquid discharge head (a tenth embodiment), which is another application example of the liquid carrying apparatus in accordance with the present invention.

In accordance with the present embodiment, the window for the heat-generating device 2 and the separation wall 8 are arranged so that the movable region of the movable separation film 5 on the upstream side becomes longer than that of the heat generating device 2. The structure is also arranged in such a manner that when vibration is given to the movable separation film 5, the undulation thus exerted is directed toward the discharge opening side. Although not shown, the portion that serves as the fulcrum point of the movable separation film on the upstream side is fixed by means of the wall of the second bubble generation liquid flow path 4 and the wall of the nozzle. FIGS. 20A and 20E represent the state where the nozzle operation is at rest.

Figure 20B:
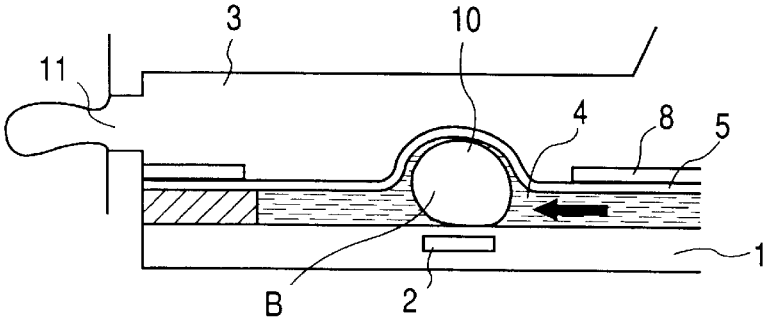
Figure 20C:
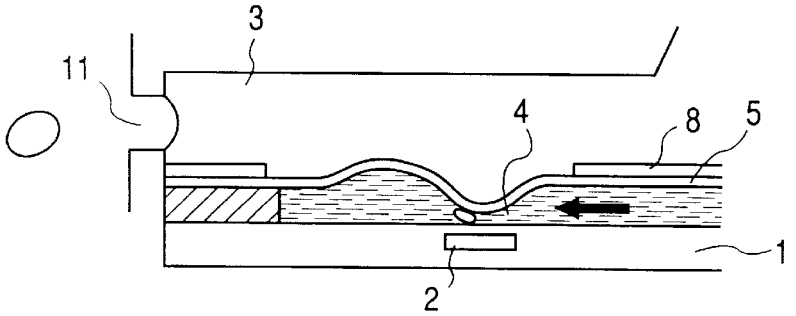
Figure 20D:
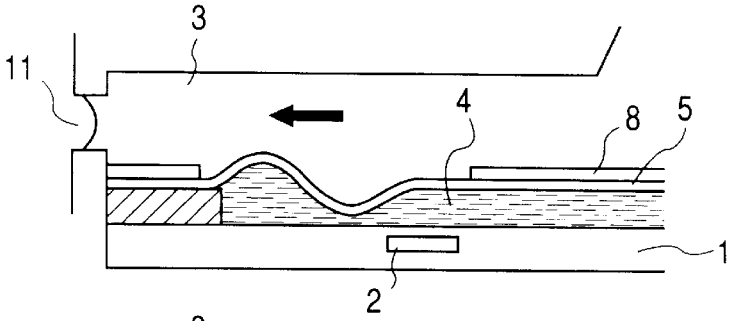
Figure 20E:
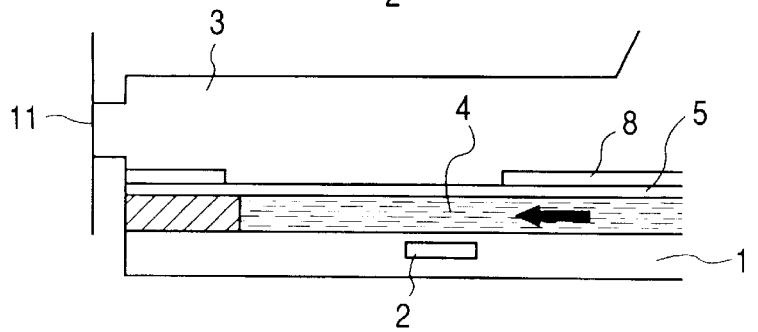

As described earlier, when the air bubble is developed on the heat generating device 2, the movable separation film 5 is displaced to the first liquid flow path 3 side (FIG. 20B). After the liquid has been discharged from the discharge opening 11, the air bubble 10 is contracted rapidly to be extinct due to the inner pressure phenomenon of the air bubble characteristic of the film boiling phenomenon as described earlier. Then, the displaced movable separation film 5 is displaced to the second flow path 4 side by the expansion capability of the film itself and more particularly, by the negative pressure exerted by the contracting air bubble 10 as shown in FIG. 20C. After the extinction of the air bubble, the region closer to the displaced area is also displaced following it. As a result, the undulation thus in progress causes the liquid in the liquid flow path to be carried. In this manner, the refilling of the discharge liquid is promoted (FIGS. 20C and 20D).

With the sufficiently longer movable region of the movable separation film 5, the undulation becomes attenuated. When the movable separation film is restored to the initial position, the refilling of the discharge liquid is completed. The settlement of the undulation may be made by the provision of a vibration absorption member on the discharge opening side of the movable region of the movable separation film. Also, in accordance with the present embodiment, it may be possible to arrange a mode in which the bubble generating liquid is also circulated per nozzle. In this case, with the progressive waves exerted by the movable separation film, the bubble generating liquid may be carried and circulated (FIG. 20D). Also, there is such effect as to prevent heat accumulation and remove remaining air bubbles as well.

With the provision of the movable region of the movable separation film on the downstream side of the heat generating device as in the embodiment described above, the undulation of the movable separation film promotes the liquid refilling. Therefore, it becomes possible to operate discharges at higher speeds than the conventional ones.

Also, for the present embodiment, higher effects are obtainable by use of the movable separation film formed by a flexible material. The same effect can be obtained by making the thickness of the movable separation film smaller.

Now, hereunder, the description will be made of the specific examples related to the embodiments described so far.

At first, the description will be made of the structure of an elementary substrate on which heat generating devices are arranged to give heat to liquid, respectively.

Figure 21A:
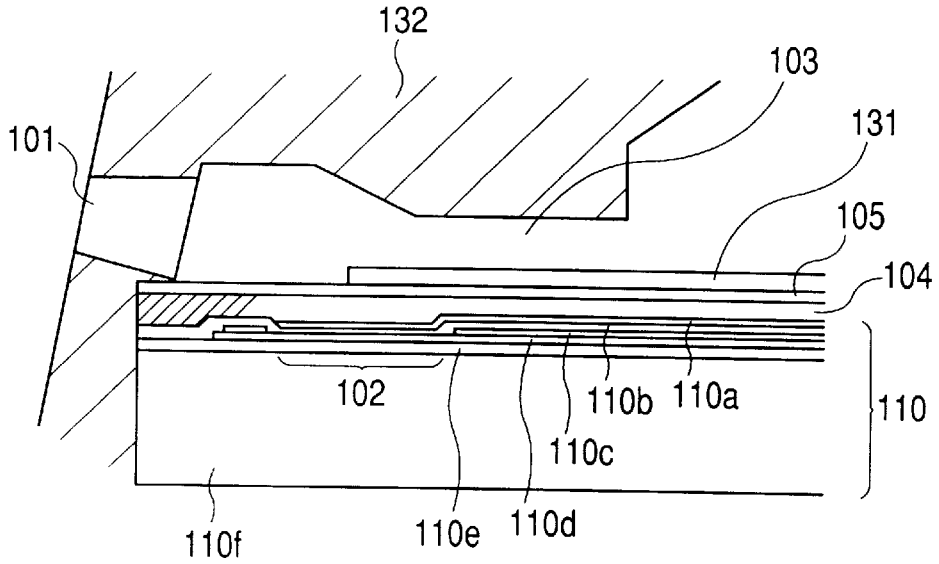
FIGS. 21A and 21B are cross-sectional views which show one structural example of the liquid jet apparatus in accordance with the present invention.
Figure 21B:
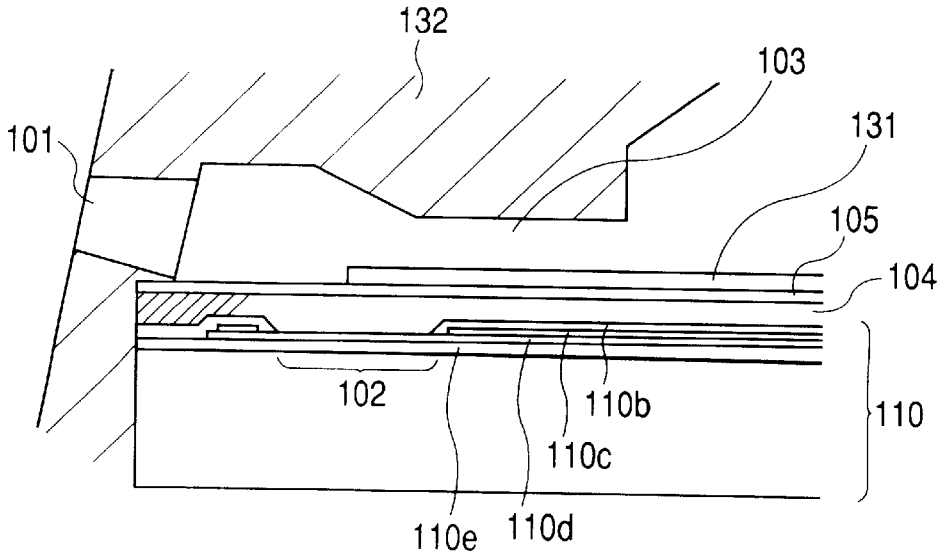

FIGS. 21A and 21B are cross-sectional view which illustrate one structural example of the liquid jet apparatus in accordance with the present invention: FIG. 21A shows the apparatus which is provided with a protection film to be described later; FIG. 21B shows the apparatus having no protection film.

As shown in FIGS. 21A and 21B, there are arranged on the elemental substrate 110, a second liquid flow path 104; a movable separation film 105 provided with the separation wall; a movable member 131; a first liquid flow path 103; and a grooved member 132 provided with groove that constitutes the first liquid flow path 103.

On the elemental substrate 110, a silicon oxide film or a silicon nitride film 110*e* is formed on the substrate 110*f* formed by silicon or the like for the purpose of insulation and heat accumulation. On such film, there are patterned, an electric resistance layer 110*d* formed hafnium boride ($HfB_2$), tantalum nitride (TaN), tantalum aluminum (TaAl) or the like, which forms a heat generating device of 0.01 to 0.2 $\mu$m, and wiring electrodes 110*c* formed by aluminum or the like in a thickness of 0.2 to 1.0 $\mu$m. Then, a voltage is applied to the electric resistance layer 110*d* from the two wiring electrodes 110*c* to cause electric current to run for generating heat. On the electric resistance layer 110*d* across the wiring electrodes 110*c*, a protection layer 110*b* of silicon oxide, silicon nitride, or the like is formed in a thickness of 0.1 to 0.2 $\mu$m. Further on it, an anti-cavitation layer 110*a* of tantalum or the like is formed in a thickness of 0.1 to 0.6 $\mu$m, hence protecting the electric resistance layer 110*d* from ink or various other kinds of liquids.

Since the pressure and shock waves which are generated are extremely strong, particularly when each of the air bubbles is generated or disappeared, the durability of the oxide film, which is hard but brittle, is reduced considerably. Therefore, tantalum (Ta) or other metallic material is used as the anti-cavitation layer 110*a*.

Also, there may be adoptable a structure that does not use any protection layer described above just by arranging an appropriate combination of the liquid, the liquid flow structure, and the resistive material. FIG. 21B shows such example.

As the material used for the resistance layer that does not require any protection layer, an alloy of iridium-tantalum-aluminum is adoptable. Now that the present invention makes it possible to separate the liquid for bubble generation use from the liquid for discharging use, it presents its particular advantage when no protection layer is adopted in such a case as this.

As described above, the structure of the heat generating device 102 adopted for the present embodiment may be provided only the electric resistance layer 110*d* (heat generating unit) across the wiring electrodes 110*c* or may be arranged to include a protection layer to protect the electric resistance layer 110*d*.

In accordance with the present embodiment, the heat generating device 102 in use is provided with the heat generating unit formed by the resistance layer that generates heat in accordance with electric signals. The present invention is not necessarily limited to it. It should be good enough if only it can create each of air bubbles in the bubble generating liquid, which is capable enough to discharge the liquid for discharging use. For example, there may be a heat generating device provided with the photothermal transducing unit as the heat generating unit that generates heat when receiving laser or other light beams or provided with a heat generating unit that generates heat when receiving high frequency.

In this respect, on the elemental substrate 110 described earlier, there may be incorporated functional devices integrally by the semiconductor manufacturing processes, such as transistors, didoes, latches, shift registers, which are needed for selectively driving the electrothermal transducing devices, besides each of the electrothermal transducing devices, which is structured by the electric resistance layer 110*d* that forms the heat generating unit, and wiring electrodes 110*c* that supply electric signals to the electric resistance layer 110*d*.

Figure 22:
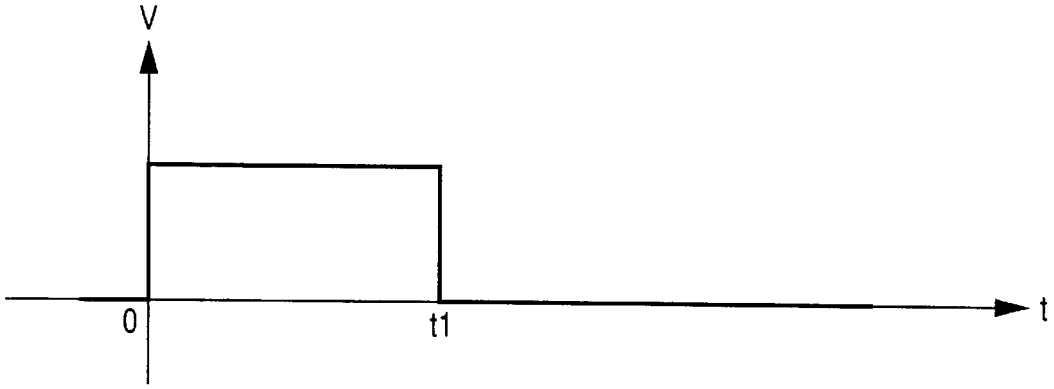
FIG. 22 is a view which shows the voltage waveform to be applied to the electric resistance layer represented in FIG. 5.

Also, it may be possible to drive the heat generating unit of each electrothermal transducing device arranged on the elemental substrate described above so as to apply rectangular pulses to the electric resistance layer 110*d* through the wiring electrodes 110*c* to cause the layer between the electrodes to generate heat abruptly for discharging liquid. FIG. 22 is a view which shows the voltage waveform to be applied to the electric resistance layer 110*d* represented in FIGS. 21A and 21B.

For the liquid jet apparatus of the embodiment described above, the electric signal of 6 kHz is applied at a voltage with the pulse width of 7 $\mu$sec, and at the electric current of 150 mA to drive each heat generating device. With the operation described earlier, ink serving as discharge liquid is discharged from each of the discharge openings. However, the present invention is not necessarily limited to these conditions of driving signal. It may be possible to apply the driving signals under any condition if only such signals can act upon the bubble generating liquid to generate bubbles appropriately.

Now, hereunder, the description will be made of the structural example of a liquid jet apparatus provided with two common liquid chambers, while curtailing the number of parts. Here, different kinds of liquids are retained in each of the common liquid chambers by separating them in good condition, which makes the remarkable reduction of costs possible.

Figure 23:
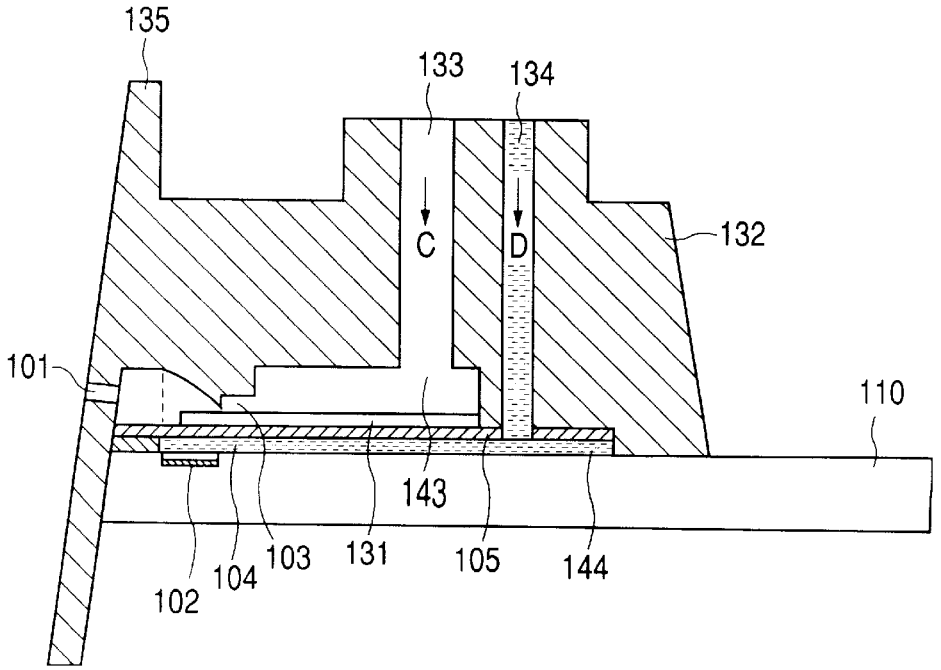
FIG. 23 is a view which schematically shows one structural example of the liquid jet apparatus in accordance with the present invention.

FIG. 23 is a view which schematically shows one structural example of the liquid jet apparatus in accordance with the present invention. In FIG. 23, the same reference marks are used for the same constituents represented in FIGS. 21A and 21B. Here, the detailed description thereof will be omitted.

The grooved member 132 for the liquid jet apparatus shown in FIG. 23 roughly comprises an orifice plate 135 having each of the discharge openings 101 thereon; a plurality of grooves that form a plurality of the first liquid flow paths 103; and recessed portion that forms the first common liquid chamber conductively connected with the plural first liquid flow paths 103 in common to supply liquid (discharge liquid) to the first liquid flow path 103.

On the lower side portion of the grooved member 132, there is bonded a movable separation film 105 which is at least partly bonded with a movable member 131, hence forming a plurality of the first liquid flow paths 103. For the grooved member 132, the first liquid supply path 133 is arranged to reach the first common liquid chamber 143 from the upper part thereof. Also, from the upper part of the grooved member, the second liquid supply path 134 is arranged to reach the interior of the second common liquid chamber 144 penetrating the movable member 131 and the movable separation film 105.

The first liquid (discharge liquid) is supplied to the first liquid flow path 103 through the first liquid supply path 133 and the first common liquid chamber 143 as indicated by an arrow C in FIG. 23. The second liquid (bubble generating liquid) is supplied to the second liquid flow path 104 through the second liquid supply path 134 and the second common liquid chamber 144 as indicated by an arrow D in FIG. 23.

Here, in accordance with the present embodiment, the second liquid supply path 134 is arranged in parallel with the first liquid supply path 133, but the present invention is not necessarily limited to this arrangement. If only the second liquid supply path is formed so as to be conductively connected with the second common liquid chamber 144 penetrating the movable separation film 105 arranged outside the first common liquid chamber 143, this path may be arranged in any way.

Also, as to the thickness (diameter) of the second liquid supply path 134, it is determined in consideration of the supply amount of the second liquid. The configuration of the second liquid supply path 134 is not necessarily circular. It may be rectangular or the like.

Also, the second common liquid chamber 144 may be formed by partitioning the grooved member 132 with the movable separation film 105. The formation method thereof is such that the frame of the common liquid chamber and the wall of the second liquid flow path are formed on the substrate 110 by use of dry film, and then, the combined body, which is arranged by the grooved member 132 having the movable separation film 105 fixed thereto, and the movable separation film 105, is adhesively bonded to the substrate 110, hence forming the second common liquid chamber 144 and the second flow path 104.

Figure 24:
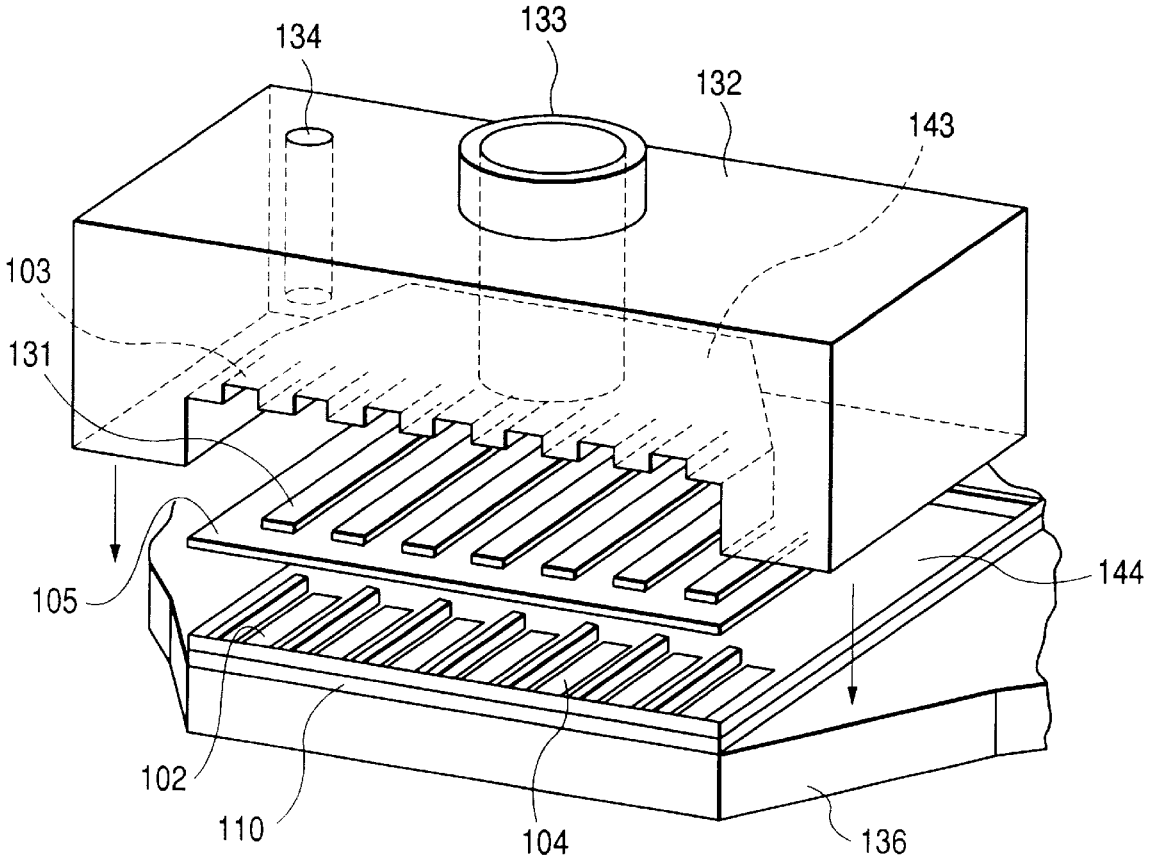
FIG. 24 is an exploded perspective view which shows one structural example of the liquid jet apparatus in accordance with the present invention.

FIG. 24 is a partly exploded perspective view which shows one structural example of the liquid jet apparatus in accordance with the present invention.

In accordance with the present embodiment, a plurality of electrothermal transducing devices serving as the heat generating devices 102 are arranged on the elemental substrate 110 on the supporting base 136 formed by metal, such as aluminum, so as to generate heat for creating each of air bubbles in the bubble generating liquid by means of film boiling generated in it.

On the elemental substrate 110, there are arranged, a plurality of grooves formed by DF dry film, which constitute the second liquid flow paths 104; the recessed portion that forms the second common liquid chamber (common bubble generating liquid chamber) 144 which is conductively connected with a plurality of second liquid flow path 104 to supply the bubble generating liquid to each of the second liquid flow paths 104; and the movable separation film 105 adhesively bonded to the movable member 131 described earlier.

The grooved member 132 is provided with the groove that constitutes the first liquid flow path (discharge liquid flow path) 103 when it is jointed to the movable separation film 105; the recessed portion that constitutes the first common liquid chamber (common discharge liquid chamber) 143 conductively connected with the discharge liquid flow path to supply discharge liquid to each of the first liquid flow paths 103; the first liquid supply path (discharge liquid supply path) 133 for supplying discharge liquid to the first common liquid chamber 143; and the second liquid supply path (bubble generating liquid supply path) 134 for supplying bubble generating liquid to the second common liquid chamber 144. The second liquid supply path 134 is connected with the conductive path that communicates with the second common liquid chamber 144 penetrating the movable member 131 and the movable separation film 105 arranged outside the first common liquid chamber 133. With the provision of this conductive path, it becomes possible to supply the bubble generating liquid to the second common liquid chamber 144 without causing any mixture with the discharge liquid.

In this respect, the arrangement relationship between the elemental substrate 110, the movable separation film 105, and the grooved member 132 is such that the movable member 131 is arranged to face the heat generating device 102 on the elemental substrate 110, and that the first liquid flow path 103 is arranged to face this movable member 131. Also, for the present embodiment, one example of the second liquid supply path 134 being provided for one grooved member 132 is described, but it may be possible to provide a plurality of second supply paths depending on the supply amount of the second liquid. Further, the sectional areas of the flow paths of the first liquid supply path 133 and the second liquid supply path 134 can be determined in proportion to the supply amounts of the respective liquids. By optimizing the sectional areas of the liquid flow paths, it becomes possible to minimize the parts needed for the formation of the grooved member 132 and others.

As described above, in accordance with the present embodiment, the second liquid supply path 134 that supplies the second liquid to the second liquid flow path 104 and the first liquid supply path 133 that supplies the first liquid to the first liquid flow path 103 can be arranged on the grooved ceiling plate that serves as one and the same grooved member. As a result, it becomes possible to curtail the number of parts, and to make the required processing steps shorter, which contributes to the significant reduction of costs.

Also, it is structured to supply the second liquid to the second common liquid chamber 144, which is conductively connected with the second liquid flow path 104, by means of the second liquid flow path 104 in the direction in which this path penetrates the movable separation film 105 that separate the first liquid and the second liquid. Therefore, the movable separation film 105, the grooved member 132, and the substrate 110 having the heat generating devices formed on it are bonded by only one process. It becomes easier to carry on the manufacturing steps, while enhancing the accuracy with which these members are bonded, leading to a better condition of liquid discharging.

Also, the second liquid is supplied to the second common liquid chamber 144 penetrating the movable separation film 105, hence making it possible to supply the second liquid to the second liquid flow path 104 reliably and secure the amount of supply sufficiently for the stabilized discharges.

In accordance with the present invention as described above, the structure is arranged to provide the movable separation film 105 to which the movable member 131 is bonded. As a result, it becomes possible to discharge liquid with a higher discharge force and a higher discharge efficiency even at higher speeds than the conventional liquid jet apparatus. Also, various kinds of liquids having the properties as described earlier can be used as the bubble generating liquid. More specifically, such liquids are: methanol, ethanol, n-propanol, isopropanol, n-hexan, n-heptane, n-octane, toluene, xylene, methyl dioxide, trichrene, Freon TF, Freon BF, ethyl ether, dioxane, cychrohexane, methyl acetate, ethyl acetate, acetone, methyl ether ketone, water, and its mixtures.

As the discharge liquid, it is possible to use various kinds of liquids irrespective of the presence or absence of its bubble generation capability and thermal properties. Also, it is possible to use even the liquid whose bubble generation capability is so low that its discharge is made difficult, the liquid whose quality is easily changeable or easily deteriorated due to heat, or a highly viscous liquid, among some others.

However, as an appropriate discharge liquid, it is desirable to use the one which does not hinder the discharge, bubble generation, the operations of the movable separation film and movable member or the like due to the properties of the liquid itself or by the reaction of bubble generating liquid.

As the discharge liquid for recording use, it is possible to use highly viscous ink or the like.

As the discharge liquids other than such ink, it may also be possible to use such liquid as a medical product or perfume, which is weaker against heat.

Here, recording is made by combining the liquid having the following composition with the bubble generating liquid and discharge liquid. As a result, it is ascertained that the liquid having a viscosity of as high as 150 cp can be discharged in good condition, not to mention the one having the viscosity of ten and several cp, which is not easily discharged by use of the conventional liquid jet apparatus; then, all the printed objects are obtained in high image quality:

| | | |
|---|---|---|
| Bubble generating liquid 1 | ethanol | 40 wt % |
| | water | 60 wt % |
| Bubble generating liquid 2 | water | 100 wt % |
| Bubble generating liquid 3 | isopropyl alcohol | 10 wt % |
| | water | 90 wt % |
| Discharge liquid | carbon black | 5 wt % |
| (Pigment abt 15 cp) | styrene - | 1 wt % |
| | acryl acetate - | |
| | acryl acetate ethyl polymer | |
| | dispersion agent (oxide 140, | |
| | weight average molecular | |
| | weight 8000) | |
| | monoethanol amine | 0.25 wt % |
| | glycerin | 6.9 wt % |
| | tiodiglycol | 5.0 wt % |
| | ethanol | 3.0 wt % |
| | water | 16.75 wt % |
| Discharge liquid 2 (55 cp) | polyethylene glycol 200 | 100 wt % |
| Discharge liquid 3 (150 cp) | polyethylene glycol 600 | 100 wt % |

Now, if the liquid is the one that is not easily discharged as described earlier, the discharge speed becomes slower. Therefore, the variation of discharge directivities is promoted, resulting in the inferior shooting accuracy of dots on a recording sheet, and also, the variation of discharge amount takes place due to instable discharges. This tendency makes it difficult to obtain images in high quality. However, with the structure of the embodiments described above, each of the air bubbles is created sufficiently and stably by use of bubble generating liquid. Therefore, it becomes possible to enhance the shooting accuracy of droplets, and the stabilization of ink discharge amounts as well. The quality of recorded images is remarkably improved.

Now, the description will be made of the manufacturing processes of the liquid jet apparatus in accordance with the present invention.

To describe the processes briefly, the wall of the second liquid flow path is formed on the elemental substrate. The movable separation film is installed on it. Further on it, there is installed the grooved member provided with the groove and others that constitute the first liquid flow path, or after the wall of the second liquid flow path has been formed, the grooved member, having installed on it the movable separation film provided with the movable member bonded thereto, is bonded onto the wall of the second liquid flow path. In this way, the apparatus is manufactured.

Here, further, the detailed description will be made of the method for manufacturing the second flow path.

At first, on the elemental substrate (silicon wafer), electrothermal transducing devices provided with the heat generating devices formed by hafnium boride, tantalum, or the like are formed by use of the same manufacturing system as the one used for manufacturing semiconductors. After that, the surface of each elemental substrate is rinsed for the purpose of enhancing the close contactness with the photosensitive resin in the next step of processing. Further, in order to enhance such close contactness, the surface of the elemental substrate is given the surface improvement treatment by the application of ultraviolet—ozone or the like. Then, the liquid, which is, for example, prepared by diluting silane coupling agent (manufactured by Nihon Unika Inc.: A189) to one wt % by use of ethylalcohol, is spin coated on the surface to be improved.

In the next step, on the substrate whose surface is rinsed to improve its close contactness, an ultraviolet photosensitive resin film (manufactured by Tokyo Ohka Inc.: dry film Odil SY-318) DF is laminated. Then, on the dry film DF, a photomask PM is arranged, and ultraviolet rays are irradiated on the portion of the dry film DF, which should remain as the wall of the second liquid flow path, through the photomask PM. This exposure process is conducted by use of MPA-600 manufactured by Canon Incorporated with the exposure amount of approximately 600 mj/cm$^2$.

Then, the dry film DF is developed by use of a development liquid (manufactured by Tokyo Ohka Inc.: BMRC-3) formed by the mixture of xylene and butyl-cellsorbi-acetate so that non-exposed portion is dissolved. Thus, the portion that has been exposed and hardened is formed as the wall portion of the second liquid flow path. Further, the residue remaining on the surface of the elemental substrate is removed by the treatment of approximately 90 seconds using the oxygen plasma ashing equipment (manufactured by Alkantec Inc.: MAS-800). In continuation, the exposed portion is completely hardened at 150° C. by means of the ultraviolet irradiation of 100 mj/cm$^2$ for two hours.

With the method described above, it is possible to form the second liquid flow path uniformly in good precision on each of the heater boards (elemental substrates) divided and manufactured from the above-mentioned silicon substrate. In other words, the silicon substrate is cut into each of the heater boards by use of the dicing machine (manufactured by Tokyo Seimitsu Inc.: AWD-4000) having the diamond blade of 0.05 mm thick mounted on it. Each of the separated heater boards is fixed to the aluminum base plate by the application of bonding agent (manufactured by Toray Inc.: SE4400).

Then, the printed-circuit board which is adhesively bonded to the aluminum base plate in advance is connected with the heater board by means of aluminum wire of 0.05 mm diameter.

After that, to the heater board thus obtained, the coupled body of the grooved member and the movable separation film by use of the method described above is positioned and bonded together. In other words, the grooved member provided with the movable separation film is positioned to the heater board, and then, coupled with the board together by means of the pressure spring and fixed. After that, the ink and bubble generating liquid supply member is adhesively bonded to the aluminum base plate for fixation, and the silicone sealant (manufactured by Toshiba Silicone Inc.: TSE399) is applied to seal the gaps between the aluminum wires, the groove member, the heater board, and ink and bubble generating liquid supply member, thus completing the manufacture of the second liquid flow path.

With the formation of the second liquid flow path by the method of manufacture described above, it becomes possible to obtain the flow path in good precision without any positional deviation with respect to each heater of the heater boards. Particularly, the grooved member and the movable separation film are coupled in advance in the preceding process. In this manner, the accuracy is enhanced in positioning the first liquid flow path and the movable member. Then, with these highly precise techniques of manufacture, the stabilized liquid discharge is implemented for the enhancement of print quality. Also, it is possible to form the devices on the wafer at a time for the large-scale manufacture at lower costs.

Here, in accordance with the present embodiment, the dry film of the ultraviolet hardening type is used for the formation of the second liquid flow path, but it may also be possible to remove resin directly from the portion that becomes the second liquid flow path by use of the resin having the absorption zone in the ultraviolet region, particularly in the region close to 248 nm, and then, after laminating, it is hardened by the application of excimer laser.

Also, the first liquid flow path or the like is formed by bonding the ceiling plate, which is provided with the recessed portion having the orifice plate with the discharge openings formed thereon; the groove that constitutes the first liquid flow path; and the first common liquid chamber that supplied the first liquid to a plurality of the first liquid flow path in common; to the aforesaid combined body of the substrate and the movable separation film. The movable separation film is fixed by being nipped by the grooved ceiling plate and the wall of the second liquid flow path. In this respect, the movable separation film is not only fixed on the substrate side, but also, it may be positioned to the substrate and fixed after having been fixed on the grooved ceiling plate as described above.

Now, as the materials for the movable member 131 that serves as means for regulating, it is preferable to use highly durable metal, such as silver, nickel gold, iron titanium, aluminum, platinum, tantalum, stainless steel, or phosphor bronze, or alloys thereof, or resin having acrylonitrile, butadiene, styrene or other nitrile group, resin having polyamide or other amide group, resin having polycarbonate or other carboxyl group, resin having polyacetal or other aldehyde group, resin having polysulfone or other sulfone group, or resin having liquid crystal polymer or the like and its chemical compound, such metal as having high resistance to ink as gold, tungsten, tantalum, nickel, stainless steel, or tantalum, or its alloys and those having them coated on its surface for obtaining resistant of ink, or resin having poly amide or other amide group, resin having polyacetal or other aldehyde group, resin having polyether ketone or other ketone group, resin having polyime or other imide group, resin having phenol resin or hydroxyl group, resin having polyethylene or other ethyl group, resin having polypropylene or other alkyl group, resin having epoxy resin or other epoxy group, resin having melamine resin or other amino group, resin having xylene resin or other methylol group, and its compounds, and further, ceramics such as silicon dioxide and its compound.

Also, as the materials for the movable separation film 105, it is preferable to use, besides the polyime described earlier, resin having good properties of resistance to heat and solvent, and presenting a good formability as typically represented by engineering plastics in recent years, which also has elasticity and capability of being made thinner, and its compound as well. These are such as polyethylene, polypropylene, polyamide, polyethylene telephthalate, melamine resin phenol resin, polybutadiene, polyurethane, polyether etherketone, polyether sulfone, polyarylate, silicone rubber, polysulfone.

Also, the thickness of the movable separation film 105 may be determined in consideration of the materials, configurations, and the like from the viewpoint of whether or not it can obtain a good strength as the separation wall, and also, whether or not its expansion and contraction are made in good condition. However, it is desirable to make the thickness thereof approximately 0.5 $\mu$m to 10 $\mu$m.

Since the present invention is structured as described above, the following effects can be demonstrated:

(1) With the provision of the pressure direction control member provided with the free end on the downstream side of the liquid flow generated by the pressure exerted by each of the air bubbles created in the pressure generating area arranged for the bubble generating liquid, the pressure thus exerted is directed to the downstream side efficiently. Also, the influence of the backwaves can be prevented. Therefore, the reversed flow of liquid does not take place, hence making it possible to effectuate liquid carriage highly efficiently.

Particularly, a plurality of bubble generation pressure generating areas are arranged in the liquid flow path together with the pressure direction control members that face them correspondingly. Then, with the sequential driving thereof from the upstream to the downstream of the liquid flow, it becomes possible to effectuate the liquid carriage in higher efficiency.

(2) With the control of driving timing with respect to each of the heat generating devices, the flow rates can be changed appropriately to make it possible to effectuate the liquid carriage in a fine quantify of less than 1/2000 g/sec.

(3) The flow path is divided into two so that different liquids can be used for use of liquid carriage and bubble generation, respectively. In this case, even the liquid whose property is weak against heat or the liquid that cannot easily generate bubbles can be carried. Also, there is no possibility that burnt substance or other deposit is accumulated on each of the heat generating devices.

(4) There is no need for the provision of the rotator which is driven by an electric motor. It becomes possible to make the apparatus smaller. Even when it is required to incorporate the apparatus in the medical equipment, biotechnological equipment, or OA equipment, which should be made lighter and smaller to meet its demand in recent years, the system that uses any one of them should be made larger.

Also, the following effect can be demonstrated by the liquid discharge head which is structured to make the liquid carrying apparatus of the present invention applicable to it:

(1) It is possible to discharge liquid from each of the discharge openings efficiently with high discharging force, because the structure is arranged so that the movable separation film on the air bubble generating area is expanded by the pressure exerted by each of the created air bubbles, and that the pressure direction control member arranged on the movable separation film is displaced to the first liquid flow path side so as to guide the aforesaid pressure in the discharge opening direction on the first liquid flow side.

(2) It is possible to obtain high discharging force more efficiently, because the movable separation film is stretched by the pressure exerted by bubble generation, and each of the air bubbles can be developed effectively larger on the downstream than the upstream, hence enabling the pressure direction control member to be displaced largely on the first liquid flow side.

(3) When the air bubble is contracted, the movable separation film is restored quickly to the original position by the pressure following the air bubble contraction, as well as by the elasticity of the pressure direction control member. Therefore, in addition to the control of the acting direction of pressure, it becomes possible to make the discharge liquid refilling speed higher in the first liquid flow path. In this manner, the stabilized discharges are obtainable even for discharge operation at higher speeds.

(4) The liquid flow path is divided into two by use of the movable separation film: one for the flow of discharge liquid, and the other for the flow of bubble generating liquid. Therefore, discharge liquid does not flow in the liquid flow path where each of the heat generating devices is arranged, hence making it possible to reduce the amount of deposit that may be accumulated on each of them even when the liquid whose property is weak against heat is used. Also, it becomes possible to make the freedom of liquid selections wider.

What is claimed is:

1. A liquid carrying method for carrying liquid by pressure exerted by the creation of an air bubble, comprising the following steps of:

using an apparatus provided with a first liquid flow path for enabling the carrying liquid to flow; a second liquid flow path provided with an air bubble generating area for creating said air bubble; a heat generating device arranged for said air bubble generating area to generate heat for the creation of said air bubble; and a movable separation film for separating said first liquid flow path and said second liquid flow path; and carrying liquid in said first liquid flow path by displacing said movable separation film, having direction regulating means for regulating the displacement direction of said movable separation film, to said first liquid flow path side by the pressure exerted by the creation of said air bubble, wherein a plurality of heat generating devices are arranged to carry liquid by driving them sequentially.

2. A liquid carrying method according to claim 1, wherein said apparatus is provided with air bubble generating areas for acting upon the flow from upstream to downstream relative to an ink ejection direction, and air bubble generating areas for acting upon the flow from downstream to upstream relative to the ink ejection direction, and the flow direction is made changeable by selectively energizing said air bubble generating areas.

3. A liquid carrying method according to claim 2, wherein the displacement timing of the movable separation film is made changeable by changing the driving speeds of the heat generating devices.

4. A liquid carrying method according to claim 3, wherein liquid is carried by the progressive waves making the movable separation film progressive in the downstream direction of the flow.

5. A liquid carrying method according to claim 3, wherein liquid in the first liquid flow path is carried by the displacement of the movable separation film in the second liquid flow path.

6. A liquid carrying method according to claim 3, wherein liquid in the second liquid flow path is carried by the displacement of the movable separation film to the interior of the first liquid flow path.

7. A liquid carrying method according to claim 3, wherein the heat generating device is an electrothermal transducing device for generating heat when electric signal is received.

8. A liquid carrying method according to claim 3, wherein the air bubble is an air bubble created by film boiling generated in liquid by the application of heat generated by the heat generating device.

9. A liquid carrying method according to claim 3, wherein the downstream portion of the air bubble is an air bubble created on the downstream of an area center of the beat generating device.

10. A liquid carrying method according to claim 2, wherein liquid is carried by the progressive waves making the movable separation film progressive in the downstream direction of the flow.

11. A liquid carrying method according to claim 2, wherein liquid in the first liquid flow path is carried by the displacement of the movable separation film in the second liquid flow path.

12. A liquid carrying method according to claim 2, wherein liquid in the second liquid flow path is carried by the displacement of the movable separation film to the interior of the first liquid flow path.

13. A liquid carrying method according to claim 2, wherein the heat generating device is an electrothermal transducing device for generating heat when electric signal is received.

14. A liquid carrying method according to claim 2, wherein the air bubble is an air bubble created by film boiling generated in liquid by the application of heat generated by the heat generating device.

15. A liquid carrying method according to claim 2, wherein the downstream portion of the air bubble is an air bubble created on the downstream of the area center of the heat generating device.

16. A liquid carrying method according to claim 1, wherein liquid is carried by the progressive waves making the movable separation film progressive in the downstream direction of the flow.

17. A liquid carrying method according to claim 16, wherein liquid in the first liquid flow path is carried by the displacement of the movable separation film in the second liquid flow path.

18. A liquid carrying method according to claim 16, wherein liquid in the second liquid flow path is carried by the displacement of the movable separation film to the interior of the first liquid flow path.

19. A liquid carrying method according to claim 16, wherein the heat generating device is an electrothermal transducing device for generating heat when electric signal is received.

20. A liquid carrying method according to claim 16, wherein the air bubble is an air bubble created by film boiling generated in liquid by the application of heat generated by the heat generating device.

21. A liquid carrying method according to claim 16, wherein the downstream portion of the air bubble is an air bubble created on a downstream side of an area center of the heat generating device.

22. A liquid carrying method according to claim 1, wherein liquid in the first liquid flow path is carried by the displacement of the movable separation film in the second liquid flow path.

23. A liquid carrying method according to claim 22, wherein liquid in the second liquid flow path is carried by the displacement of the movable separation film to the interior of the first liquid flow path.

24. A liquid carrying method according to claim 22, wherein the heat generating device is an electrothermal transducing device for generating heat when electric signal is received.

25. A liquid carrying method according to claim 22, wherein the air bubble is an air bubble created by film boiling generated in liquid by the application of heat generated by the heat generating device.

26. A liquid carrying method according to claim 22, wherein the downstream portion of the air bubble is an air bubble created on a downstream side of an area center of the heat generating device.

27. A liquid carrying method according to claim 1, wherein liquid in the second liquid flow path is carried by the displacement of the movable separation film to the interior of the first liquid flow path.

28. A liquid carrying method according to claim 27, wherein the heat generating device is an electrothermal transducing device for generating heat when electric signal is received.

29. A liquid carrying method according to claim 27, wherein the air bubble is an air bubble created by film boiling generated in liquid by the application of heat generated by the heat generating device.

30. A liquid carrying method according to claim 27, wherein the downstream portion of the air bubble is an air bubble created on a downstream side of an area center of the heat generating device.

31. A liquid carrying method according to claim 1, wherein the heat generating device is an electrothermal transducing device for generating heat when electric signal is received.

32. A liquid carrying method according to claim 31, wherein the air bubble is an air bubble created by film boiling generated in liquid by the application of heat generated by the heat generating device.

33. A liquid carrying method according to claim 31, wherein the downstream portion of the air bubble is an air bubble created on a downstream side of an area center of the heat generating device.

34. A liquid carrying method according to claim 1, wherein the air bubble is an air bubble created by film boiling generated in liquid by the application of heat generated by the heat generating device.

35. A liquid carrying method according to claim 34, wherein the downstream portion of the air bubble is an air bubble created on a downstream side of an area center of the heat generating device.

36. A liquid carrying method according to claim 1, wherein a downstream portion of the air bubble is an air bubble created downstream of an area center of the heat generating device.

37. A liquid carrying method according to claim 1, wherein liquid is carried by the progressive waves making the movable separation film progressive in the downstream direction of the flow.

38. A liquid carrying method according to claim 1, wherein liquid in the first liquid flow path is carried by the displacement of the movable separation film in the second liquid flow path.

39. A liquid carrying method according to claim 1, wherein liquid in the second liquid flow path is carried by the displacement of the movable separation film to the interior of the first liquid flow path.

40. A liquid carrying method according to claim 1, wherein the heat generating device is an electrothermal transducing device for generating heat when electric signal is received.

41. A liquid carrying method according to claim 1, wherein the air bubble is an air bubble created by film boiling generated in liquid by the application of heat generated by the heat generating device.

42. A liquid carrying method according to claim 1, wherein the downstream portion of the air bubble is an air bubble created on the downstream of an area center of the heat generating device.

43. A liquid carrying method for carrying liquid by pressure exerted by the creation of air bubble, comprising the following steps of:

using an apparatus provided with a first liquid flow path for enabling the carrying liquid to flow; a second liquid flow path provided with an air bubble generating area for creating said air bubble; a heat generating device arranged for said air bubble generating area to generate heat for the creation of said air bubble; and a movable separation film for separating said first liquid flow path and said second liquid flow path essentially or more preferably, separating them completely, said movable separation film being provided with a pressure direction control member having a free end thereof on one end and a fulcrum point thereof on another end on said air bubble generating area; and carrying liquid in said first liquid flow path from the fulcrum point side to the tree end side of said pressure direction control member by displacing said free end to said first liquid flow path side by enabling pressure exerted by the creation of said air bubble to act upon said pressure direction control member through said movable separation film in order to guide said pressure to said first liquid flow side, wherein a plurality of pressure direction control members and heat generating devices are arranged to carry liquid by driving them sequentially.

44. A liquid carrying method according to claim 43, wherein said apparatus is provided with air bubble generating areas for acting upon the flow from upstream to downstream relative to an ink election direction, and air bubble generating areas for acting upon the flow from downstream to upstream relative to the ink ejection direction, and the flow direction is made changeable by selectively energizing said air bubble generating areas.

45. A liquid carrying method according to claim 43 or claim 44, wherein the displacement timing of the pressure direction control member is made changeable by changing the driving speeds of the heat generating devices.

46. A liquid carrying method according to claim 44, wherein liquid is carried by vibrating the movable separation film having the pressure direction control member arranged therefor.

47. A liquid carrying method according to claim 44, wherein liquid in the first liquid flow path is carried by the displacement of the pressure direction control member having the movable separation film arranged therefor to the interior of the second liquid flow path.

48. A liquid carrying method according to claim 44, wherein liquid in the second liquid flow path is carried by the displacement of the pressure direction control member having the movable separation film arranged therefor to the interior of the first liquid flow path.

49. A liquid carrying method according to claim 44, wherein the free end of the pressure direction control member is positioned on a downstream side of an area center of the heat generating device.

50. A liquid carrying method according to claim 44, wherein the pressure direction control member is formed by the same material as the one used for the movable separation film.

51. A liquid carrying method according to claim 44, the pressure direction control member is formed by metal.

52. A liquid carrying method according to claim 44, wherein the heat generating device is an electrothermal transducing device for generating heat when electric signal is received.

53. A liquid carrying method according to claim 44, wherein the air bubble is an air bubble created by film boiling generated in liquid by the application of heat generated by the heat generating device.

54. A liquid carrying method according to claim 44, wherein the downstream portion of the air bubble is an air bubble created on a downstream side of an area center of the heat generating device.

55. A liquid carrying method according to claim 45, wherein liquid is carried by vibrating the movable separation film having the pressure direction control member arranged therefor.

56. A liquid carrying method according to claim 45, wherein liquid in the first liquid flow path is carried by the displacement of the pressure direction control member having the movable separation film arranged therefor to the interior of the second liquid flow path.

57. A liquid carrying method according to claim 45, wherein liquid in the second liquid flow path is carried by the displacement of the pressure direction control member having the movable separation film arranged therefor to the interior of the first liquid flow path.

58. A liquid carrying method according to claim 45, wherein the free end of the pressure direction control member is positioned on a downstream side of an area center of the heat generating device.

59. A liquid carrying method according to claim 45, wherein the pressure direction control member is formed by the same material as the one used for the movable separation film.

60. A liquid carrying method according to claim 45, the pressure direction control member is formed by metal.

61. A liquid carrying method according to claim 45, wherein the heat generating device is an electrothermal transducing device for generating heat when electric signal is received.

62. A liquid carrying method according to claim 45, wherein the air bubble is an air bubble created by film boiling generated in liquid by the application of heat generated by the heat generating device.

63. A liquid carrying method according to claim 45, wherein the downstream portion of the air bubble is an air bubble created on a downstream side of an area center of the heat generating device.

64. A liquid carrying method according to claim 43, wherein liquid is carried by vibrating the movable separation film having the pressure direction control member arranged therefor.

65. A liquid carrying method according to claim 64, wherein liquid in the first liquid flow path is carried by the displacement of the pressure direction control member having the movable separation film arranged therefor to the interior of the second liquid flow path.

66. A liquid carrying method according to claim 64, wherein liquid in the second liquid flow path is carried by the displacement of the pressure direction control member having the movable separation film arranged therefor to the interior of the first liquid flow path.

67. A liquid carrying method according to claim 64, wherein the free end of the pressure direction control member is positioned on a downstream side of an area center of the beat generating device.

68. A liquid carrying method according to claim 64, wherein the pressure direction control member is formed by the same material as the one used for the movable separation film.

69. A liquid carrying method according to claim 64, the pressure direction control member is formed by metal.

70. A liquid carrying method according to claim 64, wherein the heat generating device is an electrothermal transducing device for generating heat when electric signal is received.

71. A liquid carrying method according to claim 64, wherein the air bubble is an air bubble created by film boiling generated in liquid by the application of heat generated by the heat generating device.

72. A liquid carrying method according to claim 64, wherein the downstream portion of the air bubble is an air bubble created on a downstream side of an area center of the heat generating device.

73. A liquid carrying method according to claim 43, wherein liquid in the first liquid flow path is carried by the displacement of the pressure direction control member having the movable separation film arranged therefor to the interior of the second liquid flow path.

74. A liquid carrying method according to claim 73, wherein liquid in the second liquid flow path is carried by the displacement of the pressure direction control member having the movable separation film arranged therefor to the interior of the first liquid flow path.

75. A liquid carrying method according to claim 73, wherein the free end of the pressure direction control member is positioned on a downstream side of an area center of the heat generating devices.

76. A liquid carrying method according to claim 73, wherein the pressure direction control member is formed by the same material as the one used for the movable separation film.

77. A liquid carrying method according to claim 73, the pressure direction control member is formed by metal.

78. A liquid carrying method according to claim 73, wherein the heat generating device is an electrothermal transducing device for generating heat when electric signal is received.

79. A liquid carrying method according to claim 73, wherein the air bubble is an air bubble created by film boiling generated in liquid by the application of heat generated by the heat generating device.

80. A liquid carrying method according to claim 73, wherein the downstream portion of the air bubble is an air bubble created on a downstream side of an area center of the heat generating device.

81. A liquid carrying method according to claim 43, wherein liquid in the second liquid flow path is carried by the displacement of the pressure direction control member having the movable separation film arranged therefor to the interior of the first liquid flow path.

82. A liquid carrying method according to claim 81, wherein the free end of the pressure direction control member is positioned on a downstream side of an area center of the heat generating device.

83. A liquid carrying method according to claim 81, wherein the pressure direction control member is formed by the same material as the one used for the movable separation film.

84. A liquid carrying method according to claim 81, the pressure direction control member is formed by metal.

85. A liquid carrying method according to claim 81, wherein the heat generating device is an electrothermal transducing device for generating heat when electric signal is received.

86. A liquid carrying method according to claim 81, wherein the air bubble is an air bubble created by film boiling generated in liquid by the application of heat generated by the heat generating device.

87. A liquid carrying method according to claim 81, wherein the downstream portion of the air bubble is an air bubble created on a downstream side of an area center of the heat generating device.

88. A liquid carrying method according to claim 43, wherein the free end of the pressure direction control member is positioned on a downstream side of an area center of the heat generating device.

89. A liquid carrying method according to claim 88, wherein the pressure direction control member is formed by the same material as the one used for the movable separation film.

90. A liquid carrying method according to claim 88, the pressure direction control member is formed by metal.

91. A liquid carrying method according to claim 88, wherein the heat generating device is an electrothermal transducing device for generating heat when electric signal is received.

92. A liquid carrying method according to claim 88, wherein the air bubble is an air bubble created by film boiling generated in liquid by the application of heat generated by the heat generating device.

93. A liquid carrying method according to claim 88, wherein the downstream portion of the air bubble is an air bubble created on a downstream side of an area center of the heat generating device.

94. A liquid carrying method according to claim 43, wherein the pressure direction control member is formed by the same material as the one used for the movable separation film.

95. A liquid carrying method according to claim 94, the pressure direction control member is formed by metal.

96. A liquid carrying method according to claim 94, wherein the heat generating device is an electrothermal transducing device for generating heat when electric signal is received.

97. A liquid carrying method according to claim 94, wherein the air bubble is an air bubble created by film boiling generated in liquid by the application of heat generated by the heat generating device.

98. A liquid carrying method according to claim 94, wherein the downstream portion of the air bubble is an air bubble created on a downstream side of an area center of the heat generating device.

99. A liquid carrying method according to claim 43, the pressure direction control member is formed by metal.

100. A liquid carrying method according to claim 99, wherein the heat generating device is an electrothermal transducing device for generating heat when electric signal is received.

101. A liquid carrying method according to claim 99, wherein the air bubble is an air bubble created by film boiling generated in liquid by the application of heat generated by the heat generating device.

102. A liquid carrying method according to claim 99, wherein the downstream portion of the air bubble is an air bubble created on a downstream of an area center of the heat generating device.

103. A liquid carrying method according to claim 43, wherein liquid is carried by vibrating the movable separation film having the pressure direction control member arranged therefor.

104. A liquid carrying method according to claim 43, wherein liquid in the first liquid flow path is carried by the displacement of the pressure direction control member having the movable separation film arranged therefor to the interior of the second liquid flow path.

105. A liquid carrying method according to claim 43, wherein liquid in the second liquid flow path is carried by the displacement of the pressure direction control member having the movable separation film arranged therefor to the interior of the first liquid flow path.

106. A liquid carrying method according to claim 43, wherein the free end of the pressure direction control member is positioned on a downstream side of an area center of the heat generating device.

107. A liquid carrying method according to claim 43, wherein the pressure direction control member is formed by the same material as the one used for the movable separation film.

108. A liquid carrying method according to claim 43, the pressure direction control member is formed by metal.

109. A liquid carrying method according to claim 43, wherein the heat generating device is an electrothermal transducing device for generating heat when electric signal is received.

110. A liquid carrying method according to claim 43, wherein the heat generating device is an electrothermal transducing device for generating heat when electric signal is received.

111. A liquid carrying method according to claim 43, wherein the air bubble is an air bubble created by film boiling generated in liquid by the application of heat generated by the heat generating device.

112. A liquid carrying method according to claim 43, wherein the air bubble is an air bubble created by film boiling generated in liquid by the application of heat generated by the heat generating device.

113. A liquid carrying method according to claim 43, wherein the downstream portion of the air bubble is an air bubble created on a downstream side of an area center of the heat generating device.

114. A liquid carrying method according to claim 43, wherein the downstream portion of the air bubble is an air bubble created on a downstream side of an area center of the heat generating device.

115. A liquid carrying apparatus, comprising:

a first liquid flow path through which a liquid flows;

a second liquid flow path having an air bubble generating area at which air bubbles are generated;

a plurality of heat generating devices arranged at said air bubble generating area and which generate heat to create the air bubbles;

a movable separation film separating the first liquid flow path from the second liquid flow path; and direction regulating means for regulating a displacement direction of said movable separation film toward said first liquid flow as a consequence of pressure exerted by the air bubbles, wherein the heat generating devices are sequentially driven to carry the liquid.

116. A liquid carrying apparatus for carrying a liquid, comprising:

a first liquid flow path through which the liquid flows;

a second liquid flow path having an air bubble generating area at which air bubbles are generated;

a plurality of heat generating devices arranged at said air bubble generating area and which generate heat to create the air bubbles;

a movable separation film separating the first liquid flow path from the second liquid flow path, said movable separation film having a pressure direction control member having a free end at one end and a fulcrum point at another end of said air bubble generating area; and direction regulating means for regulating a displacement direction of said movable separation film toward said first liquid flow as a consequence of pressure exerted by the air bubbles, wherein the heat generating devices are sequentially driven to carry the liquid in said first liquid flow path from the fulcrum point side to the free end side of said pressure direction control member through displacement of said free end toward said first liquid flow path side as a consequence of pressure caused by creation of said air bubbles and which acts upon said pressure direction control member through said movable separation film to guide said pressure toward said first liquid flow side.

117. A liquid discharging method comprising the steps of:

providing a liquid discharge head having a discharge opening for discharging liquid; an air bubble generating area for creating an air bubble in said liquid; a first liquid flow path conductively connected with said discharge opening; a second liquid flow path provided with said air bubble generating area; a plurality of heat generating devices arranged at said air bubble generating area and which generate head to create the air bubbles; and a movable separation film for separating said first liquid flow path and said second liquid flow path; and discharging the liquid in said first liquid flow path from said discharge opening as a result of pressure exerted by said air bubble created in said air bubble generating area, wherein an undulation of said movable separation film progresses in a direction toward said discharge opening.

118. A liquid carrying method according to claim 117, wherein the undulation of said movable separation film takes place after a bubble disappearance process of said air bubble.

119. A liquid carrying method according to claim 117 or claim 118, wherein the undulation of said movable separation film taking place after the bubble disappearance process of said air bubble satisfies the condition of:

(the restoring speed of the film by the elasticity of the movable separation film)<(the displacement speed of the movable separation film by the negative pressure exerted by bubble disappearance).

120. A liquid discharge head provided with a discharge opening for discharging liquid; an air bubble generating areas for creating air bubble in said liquid; a first liquid flow path conductively connected with said discharge opening; a second liquid flow path provided with said air bubble generating area; a plurality of heat generating devices arranged at said air bubble generating areas which generate head to create the air bubbles; and a movable separation film for separating said first liquid flow path and said second liquid flow path, and the liquid in said first liquid flow path being discharged from said discharge opening by the pressure exerted by said air bubble created in said air bubble generating area, the undulation of said movable separation film being in progress in the direction toward said discharge opening.

121. A liquid discharge head according to claim 120, wherein the center of the movable region of the movable separation film to said first liquid flow path and said second liquid flow path is on a downstream side of the center of said heat generating device.

122. A liquid discharge head according to claim 120, wherein the movable separation film is supported at least either one of the upper and lower sides in the area other than the movable region in order to regulate the progressing direction of the undulation.

* * * * *